US005095799A

United States Patent [19]

Wallace et al.

[11] Patent Number: 5,095,799

[45] Date of Patent: Mar. 17, 1992

[54] ELECTRIC STRINGLESS TOY GUITAR

[76] Inventors: Stephen M. Wallace, 518 Ava Ave., Rohnert Park, Calif. 94928; Ronald E. Milner, 13339 Fawn Hill Dr., Grass Valley, Calif. 95959; Charles S. Meyer, 12806 Pasquala Rd., Nevada City, Calif. 95959

[21] Appl. No.: 245,563

[22] Filed: Sep. 19, 1988

[51] Int. Cl.[5] ..... G10H 7/00; G10H 1/02; G10H 1/18

[52] U.S. Cl. ..... 84/609; 84/601; 84/615; 84/622; 84/626; 84/627; 446/408

[58] Field of Search ..... 84/1.14-1.16, 84/1.03, 1.01, DIG. 12, 1.13, 1.26, DIG. 4, 1.25, 1.27, 1.28, DIG. 2, 22, 29, 601, 602, 609-615, 618, 622, 625-627, 629, 634-638, 671, 672, 678, 684, 692, 694-695, 701-703, 706, 713-715, DIG. 26; 446/408, 143

[56] References Cited

U.S. PATENT DOCUMENTS

| | | | |
|---|---|---|---|
| 3,902,392 | 9/1975 | Nagahama | 84/DIG. 8 |
| 3,913,443 | 10/1975 | Jewett | 84/DIG. 29 |
| 4,089,246 | 5/1978 | Kooker | 84/1.03 X |
| 4,158,978 | 6/1979 | Hiyoshi et al. | 84/DIG. 12 |
| 4,186,642 | 2/1980 | Gross | 84/678 |
| 4,205,354 | 5/1980 | Kramer | 84/DIG. 29 |
| 4,217,804 | 8/1980 | Yamaga et al. | 84/DIG. 22 |
| 4,236,437 | 12/1980 | Howell et al. | 84/653 |
| 4,307,645 | 12/1981 | Rauchi | 84/1.03 |
| 4,379,422 | 4/1983 | Munch et al. | 84/1.19 |
| 4,406,203 | 9/1983 | Okamoto et al. | 84/1.03 |
| 4,452,119 | 6/1984 | Tanimoto | 84/1.03 |
| 4,476,767 | 10/1984 | Katsuoka | 84/478 X |
| 4,674,384 | 6/1987 | Sakurai | 84/DIG. 12 |
| 4,794,838 | 1/1989 | Corrigan, III | 84/1.01 |

FOREIGN PATENT DOCUMENTS

| | | | |
|---|---|---|---|
| 51-92233 | 2/1977 | Japan | 84/DIG. 12 |

OTHER PUBLICATIONS

"Toys", Washington Post, Feb. 19, 1989, Section F.

*Primary Examiner*—A. T. Grimley
*Assistant Examiner*—Matthew S. Smith

[57] ABSTRACT

An electronic musical instrument shaped like an electric guitar sounds individual notes that are synthesized to sound like an electric guitar. These notes may either be selected randomly selected by a player or from segments of prearranged musical tracks. The instrument provides for maintaining the tempo of manually played or preprogrammed notes, synchronizing the transitions between sequentially selected musical tracks, overlaying manual notes on the tracks, and a number of electric guitar-like sound effects including vibrato, chorus, overdrive, slurs and soft picks.

12 Claims, 16 Drawing Sheets

ELECTRIC STRINGLESS TOY GUITAR

BACKGROUND OF THE INVENTION

1. Field

The present invention relates to the field of electronic musical toys. More specifically, the present invention relates to the fields of toy electric guitars and sound synthesizers for generating guitar-like sounds.

2. Art Background

A number of electronic toy guitars have been taught in the prior art and include such examples as: A Guitar-Like Electronic Musical Instrument With Plural Manuals, U.S. Pat. No. 3,555,166; Guitars Or Like Stringed Musical Instruments, U.S. Pat. No. 3,443,018; Stringless Guitar-Like Electronic Musical Instrument, U.S. Pat. No. 3,340,343; Electronic Musical Instrument With String-Simulating Switches, U.S. Pat. No. 4,570,521; Stringless Electronic Musical Instrument, U.S. Pat. No. Re. 31,019; and Stringless Electronic Musical Instrument, U.S. Pat. No. 4,177,705. However, all of these toys require considerable skill from the player, which defeats their value as toys (as opposed to musical instrument or guitar emulators). In a toy it is desirable for the player to immediately be able to generate interesting sounds and music without having to acquire a high degree of skill. At the same time, however, it is important that the player be in control of the music, and not merely turning music on as in a player piano. Further, none of these toys has a true electric guitar-like sound.

Certain software programs, designed for use in personal computers, such as a program distributed under the "JAM SESSION" trademark by Broderbund Software, permit the simulation of a music studio and permit the end-to-end "splicing" combinations of short tracks of music together. However, these programs require expensive computers and do not provide the ease of use and "no-goof" capability that is required in an electronic musical toy.

Accordingly, it is desired to provide an electronic stringless guitar toy that always is in key, never losses the beat, permits the smooth combinations of guitar "riffs" under real-time player control, and sounds like an electric guitar.

SUMMARY OF THE INVENTION

The present invention has been specifically designed so as to require a minimal level of skill to produce musical sounds that are interesting, synchronized and in key. Provisions are made for multiple tracks of preprogrammed music. The player can jump from track to track at any time, and the guitar automatically maintains the rhythm. Further, provision is made for overlaying manual notes on the preprogrammed tracks and for the generation of various guitar effects, such as overdrive and triplets. Thus, the toy can produce interesting music with a minimum of simple controls. However, in spite of the simplicity of controls, the player is in control of the music being played.

An electric guitar sound is characterized by a distinct envelope of variation of loudness over time, and a harmonic content (coloration of the tone with higher frequency sounds) that also varies with time. The present invention generates an approximation of this kind of sound via a voltage controlled oscillator and a duty-cycle modulation circuit under microprocessor control.

More specifically, the preferred embodiment of the invention includes a unique track switching technique which provides musical continuity when tracks are switched. If a second track key is depressed either simultaneously with or within an eighth beat of the release of the first track, a switch will be made without loss of tempo at the next quarter beat time to a corresponding position within the new track. Further, in the preferred embodiment, a frequency generator provides a frequency for the tone generator independent of variations in the power supply voltage which keeps the instrument in tune despite varying battery voltage. Finally, the preferred embodiment of the invention interprets three note keys being active at the same time as a triplet, and automatically generates repeating triplets.

These and other advantages and features of the invention will become readily apparent to those skilled in the art after reading the following detailed description of the invention and studying the accompanying drawings.

DETAILED DESCRIPTION OF THE PREFERRED EMBODIMENT

Figure 1:
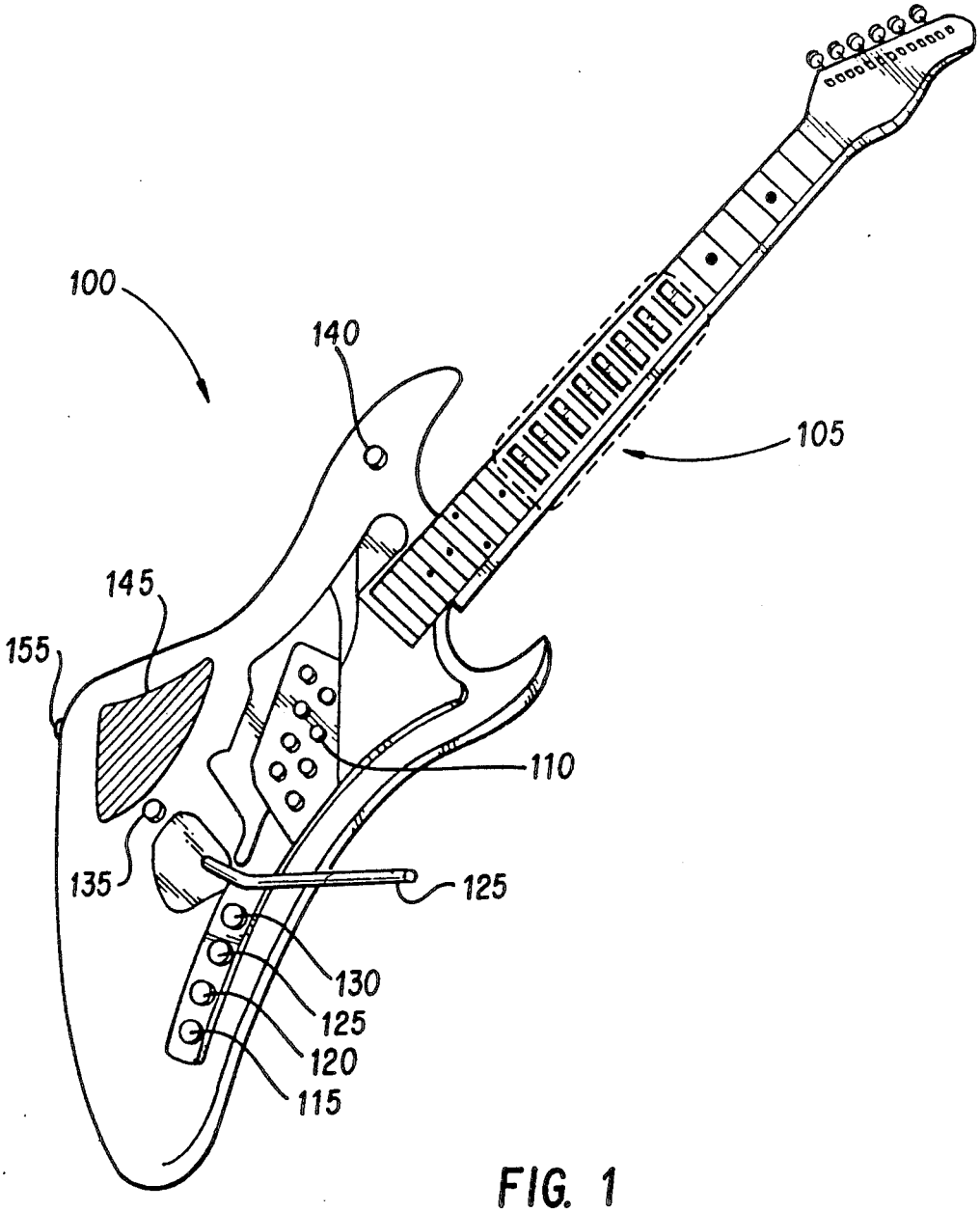
FIG. 1 is a front view of an electric stringless guitar.

FIG. 1 is a front view of an electric stringless guitar 100 in accordance with the perferred embodiment of the present invention. The controls on guitar 100 are described below with reference to FIG. 1.

CONTROLS

Track buttons

Eight (8) track buttons 105 located on the neck of guitar 100 enable the performance of preprogrammed musical tracks. Pressing one of the track buttons 105 causes a corresponding one of eight four-measure-long preprogrammed tracks to begin playing from its first beat. If a second track button is pressed while the previous one is still held, the second musical track is executed from the same rhythmic position along the four-measure score where the previous track left off. This permits the combination of parts of various tracks to be combined without losing the rhythm or structure of the musical tracks.

Note buttons

Eight (8) note buttons 110 located on the body of guitar 100 enable the manual play of single notes (also referred to as "manual notes"). In the preferred embodiment these notes correspond to notes of the "pentatonic" scale. Pressing a note button 110 overrides any sound from the tracks and causes a note corresponding to the pressed note button 110 to be played. However, the rhythm of the track is not interrupted as long as any track button 105 is held down and the play of the track is resumed when note button 110 is released.

Guitar 100 can simulate picked and slurred notes. Picking starts most sequences of notes and is rhythmically more pronounced than the alternative of slurred notes. Pressing a second note button 110 while holding the first causes the note controlled by the second button to be played with a softer attack and less volume, simulating the technique of "hammering on" a note. This corresponds to the technique on a stringed guitar where a note is hammered-on by abrupt placement of the finger on the fretboard, which substitutes for picking the string with the other hand.

A vibrato effect is engaged if a note button 110 is held for longer than one-half of a second, simulating a guitarist's finger vibrato. Vibrato, or more precisely, "finger vibrato," is an effect where the pitch of the note being sounded varies upwards slightly and back down again cyclically at a moderate rate (approximately 5 Hz.) When the key is released, the effect is turned off.

Finally, triplets are automatically composed and played in response to three (3) keys being depressed simultaneously. The first two keys played are used to determine the direction of the triplet, up or down, and the notes of the triplet include the second note played and the notes immediately above and below it on the scale.

Tempo Controls

Tempo is controlled by two (2) controls, tempo up control 115 and tempo down control 120. These push button controls are used to set the tempo or beat at which the preprogrammed tracks are performed. Tempo controls 115 and 120 have built in auto-repeat features. Press and release either key once, and the tempo is adjusted one notch in the appropriate direction; press and hold the key down and, after 0.5 seconds, the tempo is adjusted one notch every 0.25 seconds until the key is released or the tempo limit is reached.

Overdrive Control

Overdrive control 125 selects a special effect referred to as overdrive which simulates the distortion sound of electric guitars. On power up, this effect is off. Sequential activation of this control toggles the overdrive effect on and off.

Chorus Control

Chorus control 130 selects another special effect referred to as chorus which generates an effect similar to reverberation. On power up, this effect is off. Sequential activation of this control toggles the chorus effect on and off.

Pitch Control

Pitch control 135 is an analog adjustment that allows turning of the pitch of guitar 100.

Volume/Power Control

Volume/power control 140 adjusts the loudness of sound from guitar 100 from a speaker 145 and also provides the on/off function.

Tremolo Bar

Guitar 100 can also simulate bends. Notes played on a stringed guitar can be fingered at one fret and then raised up in pitch by pushing the string sideways on the fret ("bending"). The present circuitry permits continuous "bending" of notes in two ways, in response to actuation of tremolo bar 150 and in response to commands associated with the preprogrammed tracks. Tremolo bar 150 is mechanically coupled to pitch control 135 and alters the pitch of notes being played. A preprogrammed score can invoke bends of up to two half-steps of bend, in two discrete steps.

Headphone Jack

The preferred embodiment also provides a headphone jack 155.

GUITAR ELECTRONICS OVERVIEW

Figure 2:
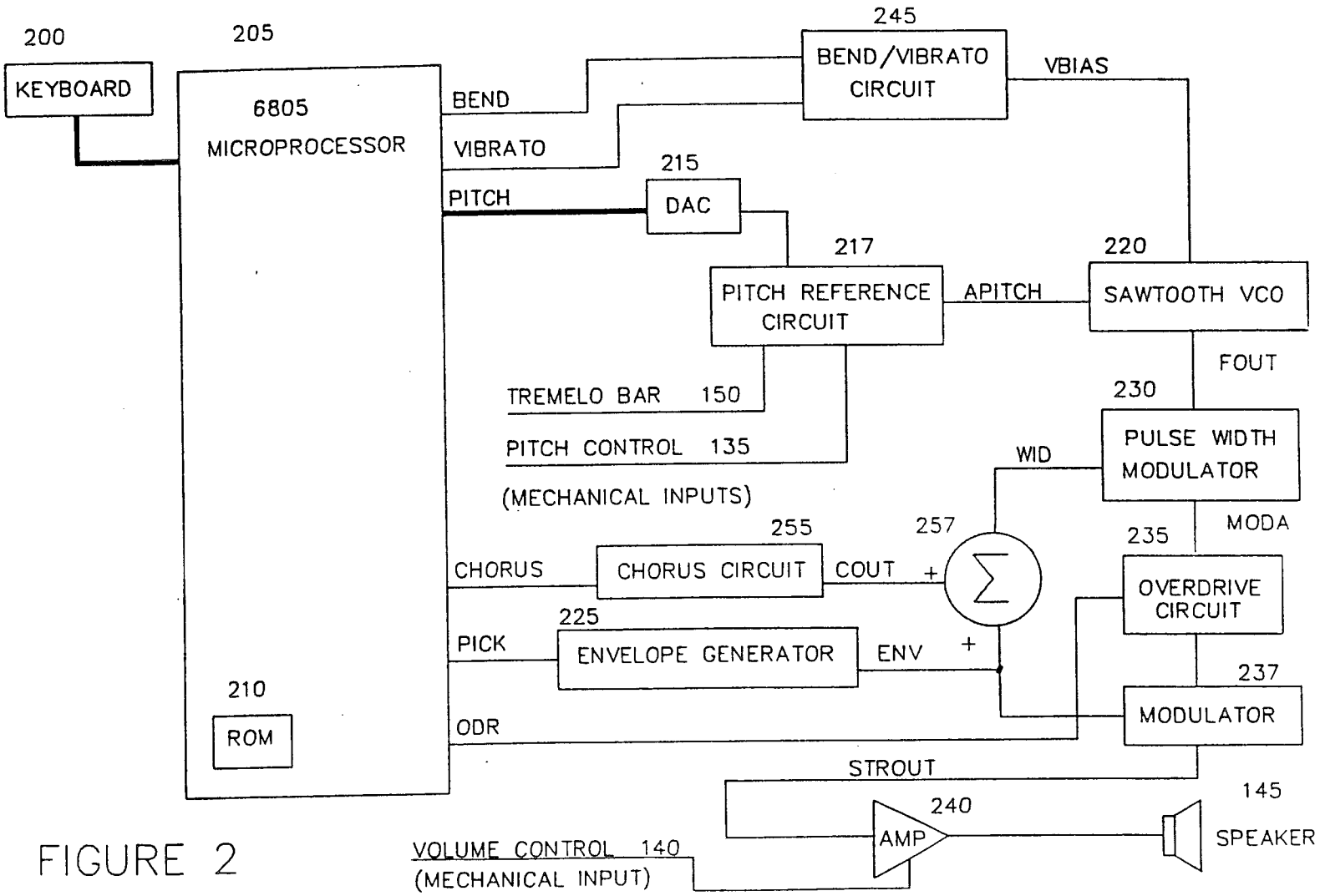
FIG. 2 is an overall block diagram of the electronics contained within the stringless guitar.
Figure 15:
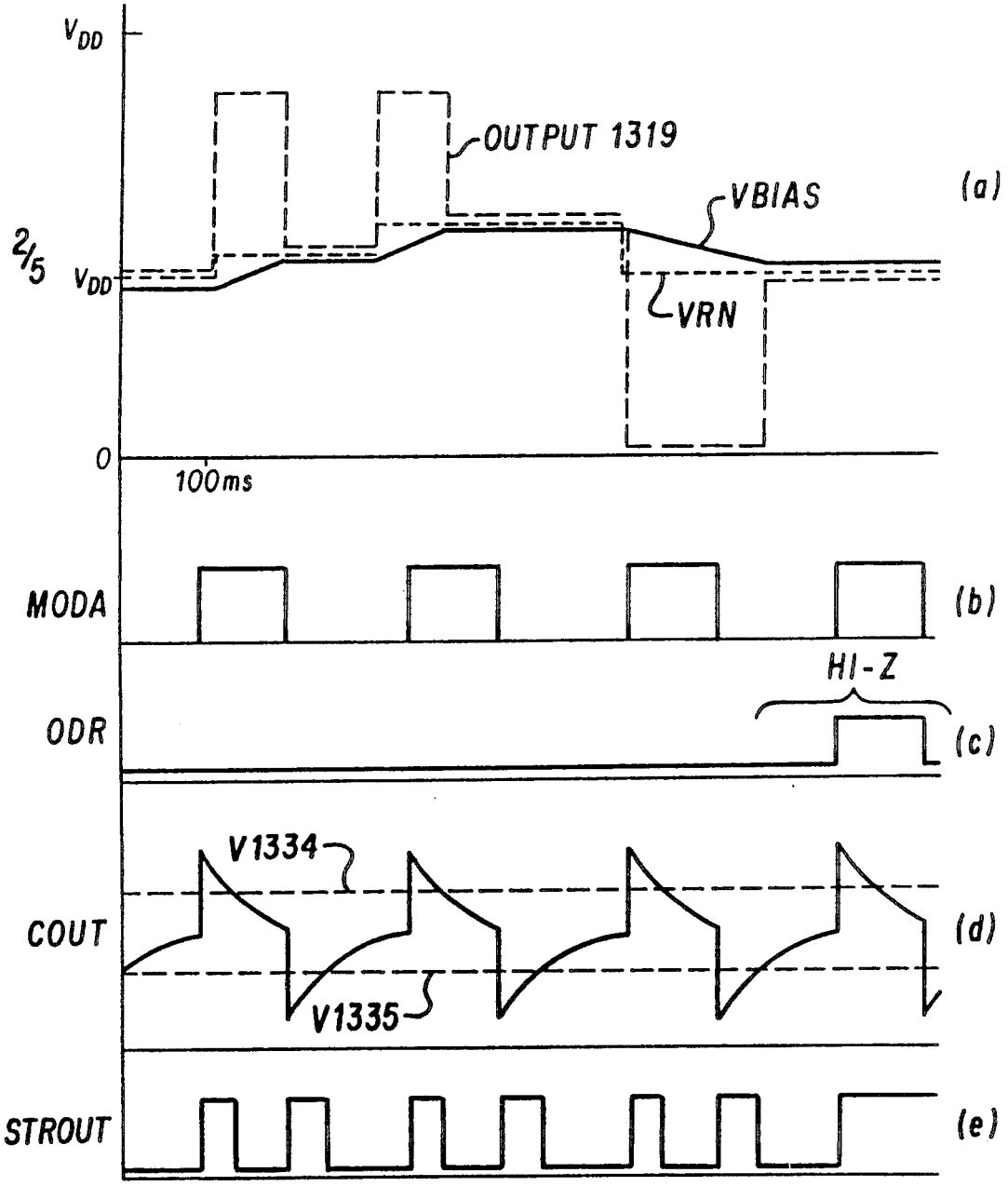
FIG. 15 is an illustration of a number of waveforms associated with the digital electronics.
Figure 16:
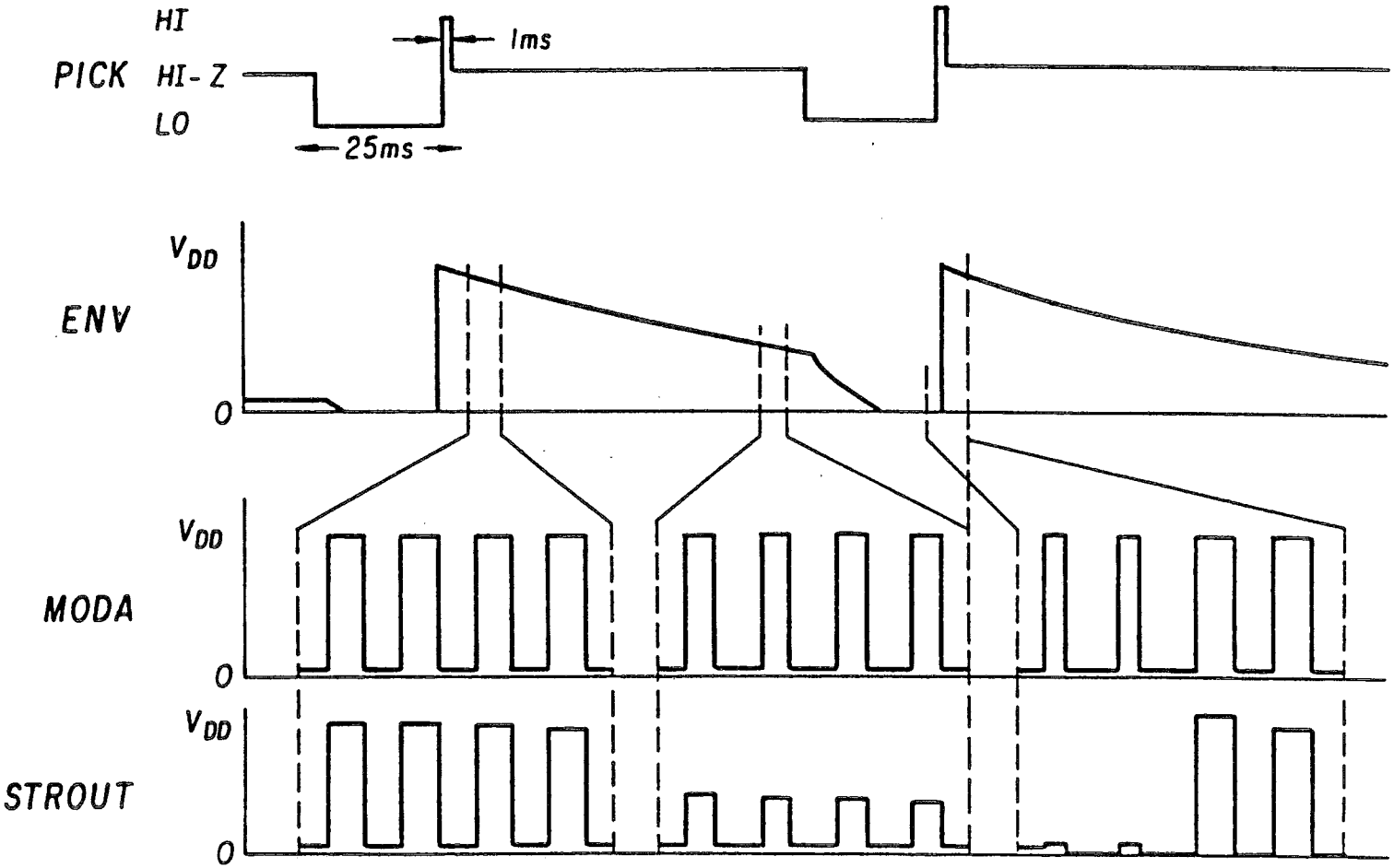
FIG. 16 is an illustration of a number of the waveforms associated with the digital electronics.

These and other effects are provided by electronics contained within guitar 100. An overall block diagram of the electronics contained within guitar 100 is illustrated in FIG. 2. FIGS. 15–17 illustrate a number of the waveforms associated with the electronics.

Buttons 105 and 110, and controls 115, 120, 125 and 130 (illustrated in FIG. 1) make up a keyboard 200 (FIG. 2) which is coupled to a 6805 microprocessor 205. Microprocessor 205 regularly scans keyboard 200, interprets the keys, and operates an analog sound synthesizer in response to the status of the keys and in response to a software program and data tables containing encoded versions of preprogrammed musical tracks. The software program and the data tables are stored in a 2 kilobyte read only memory (ROM) 210, which is internal to the 6805 microprocessor 205. ROM 210 contains a program of approximately 1.25 kilobytes and about 0.75 kilobytes of music data.

The sound produced by guitar 100 is produced by analog electronics controlled by signals provided by microprocessor 205 and is similar to the sound of a electric stringed guitar played through an overdrive distortion device, characterized by abundant harmonics, sustain and compression. Specifically, microprocessor 205 applies a digital value PITCH representing the pitch (frequency) of a desired note to an eight-bit Digital-to Analog Converter (DAC) 215. DAC 215 converts this digital value to an analog voltage which is applied to a pitch reference circuit 217. Pitch reference circuit 217 modifies the voltage of the analog pitch signal in response to activation of tremolo bar 150 and pitch control 135. The modified analog pitch signal APITCH from pitch reference circuit 217 is coupled to a sawtooth voltage-controlled-oscillator (VCO) 220. The analog output from pitch reference circuit 217 sets the frequency of VCO 220, which generates a sawtooth waveform FOUT having a linear negative ramp and a vertical up portion.

Microprocessor 205 is coupled to a envelope generator 225 and applies a PICK signal to envelope generator 225 which can be either high, low or tri-state. Envelope generator 225 generates the attack and sustain envelopes for notes in response to the PICK signal. This envelope signal, ENV, is applied to summer 257 and modulator 237.

The chorus effect is provided by a chorus circuit 255 in response to a CHORUS signal from microprocessor 205. The output, COUT, from chorus circuit 255, is applied to summer 257 where it is summed with the ENV signal to produce a WID signal which is applied to pulse width modulator 230.

Sawtooth waveform FOUT generated by sawtooth VCO 220 is coupled to one input of pulse-width modulator 230. The WID signal is coupled to another input of pulse-width modulator 230. Pulse-width modulator 230 varies the pulse width of the MODA signal in response to the amplitude of the WID signal.

Pulse-width modulator 230 is coupled to overdrive circuit 235. Overdrive circuit 235 is also coupled to microprocessor 205 and applies an overdrive effect to the MODA signal in response to an ODR signal from microprocessor 205. The output from overdrive circuit 235 is coupled to modulator 237 which provides the STROUT signal. The STROUT signal is coupled to an audio amplifier 240 which drives speaker 145 of guitar 100. Audio amplifier 240 varies the amplitude of the audio output applied to speaker 145 in response to activation of volume control 140.

The effects of vibrato (low frequency FM) and pitch bend (continuously variable frequency offset) are added by varying a reference input voltage VBIAS to VCO 220. Specifically, microprocessor 205 provides a BEND signal and a VIBRATO signal to a bend/vibrato circuit 245 when these effects are desired. The output of bend/vibrato circuit 245, VBIAS, is coupled to VCO 220 as the reference voltage which modifies the frequency of oscillation of VCO 220. The frequency of VCO 220 varies linearly with voltage VBIAS.

Software Overview

There are twenty (20) keys in keyboard 200. Eight (8) note buttons 110 for manual notes, eight (8) track buttons 105 for preprogrammed musical tracks, and four (4) other controls. Keyboard 200 is scanned once every 5 msec. Once scanned, the software then divides the keyboard into three (3) sets of keys and treats each set as a separate keypad.

Both note and track keypads are treated as conventional "2 key rollover with three key lockout" keypads. The control keys are treated as "1 key only with 2 key lock out" keypads.

When playing the manual notes, a single note is sounded in response to the play of each manual button. The note is generally sounded in such a fashion as to generate a picked sound. If a second key is depressed while the first is still down, it will be sounded next, only a softer pick is generated. This softer pick effect corresponds to the hammer-on sound. If only one of the two (2) keys is released, the remaining key is used to determine the pitch and the note is sustained. In the case of three (3) keys pressed simultaneously, a triplet is automatically generated by the software. The first two keys played, (notes 1 and 2, are used to determine the starting pitch and the direction of the triplet, up or down, based on the relationship of the first two notes. If the direction of the triplet is up, then the triplet is composed by playing the note below note 2 (the second note), note 2, and the note above note 2. Similarly, if the direction of the triplet is down, the triplet is composed by playing the note above note 2, note 2, and the note below note 2.

When a track key 105 is depressed, a four (4) measure track of music is initiated. For the case of the first track key down, the selected track starts at the beginning of the track. The track continues to play as long as the key is held down, repeating over and over as long as the key is depressed. If the key is released the track will continue playing to the end of the current measure. If a second track key is depressed either simultaneously with or within an eighth beat of the release of the first track, a switch will be made without loss of tempo at the next quarter beat time to a corresponding position within the new track. For example, if the first track was half over when the second track key was depressed, the second track would be entered near its mid-point (at the next quarter beat). If no track key is held down for an eighth beat, then the track play is re-initialized and the next track key played will start the new track from the beginning of the track synchronized with the press of the key.

When manual notes are played in conjunction with the preprogrammed tracks, the manual notes have priority. If a note is played first and then a track key is played, or if a track key is played while a note key is depressed, the track will not start until the manual note is released and a time delay of one eight beat has elapsed. The track then starts from its beginning. If a track key is played first, and then a manual note is played over it, the manual note will not play until the current track note (or rest) is done. The manual notes then again have priority. So long as the track key is held down the track plays "silently", maintaining its tempo. In this way, manual notes can be "laid over" the track and music played by the player can be substituted for segments of music within the prerecorded tracks. The track will resume play (become audible) after a manual note is released and an eighth beat delay has elapsed without another manual note being played.

Software Details

The guitar software has two distinct types of timing variables. A first type of time variable is based on a 1 msec time base derived from a free running timer internal to microprocessor 205. Other time variables are based on "IRQ" signals (short for "interrupt request signals") generated by an IRQ routine every forty eighth beat by using a timer compare function. The period between IRQ signals is modified by microprocessor 205 in response to the tempo and can range in duration from approximately 28 msec to 67 msec. All music is initiated by and synchronized to IRQ signals which permits the tempo of the guitar to be modified in software by varying the value to which the timer is compared, even while music is being played. Since all musical notes, including notes from tracks and manual notes, are synchronized to the nearest forty eighth beat, notes and tracks can be played and switched without loss of tempo.

Figures 3A, 3B:
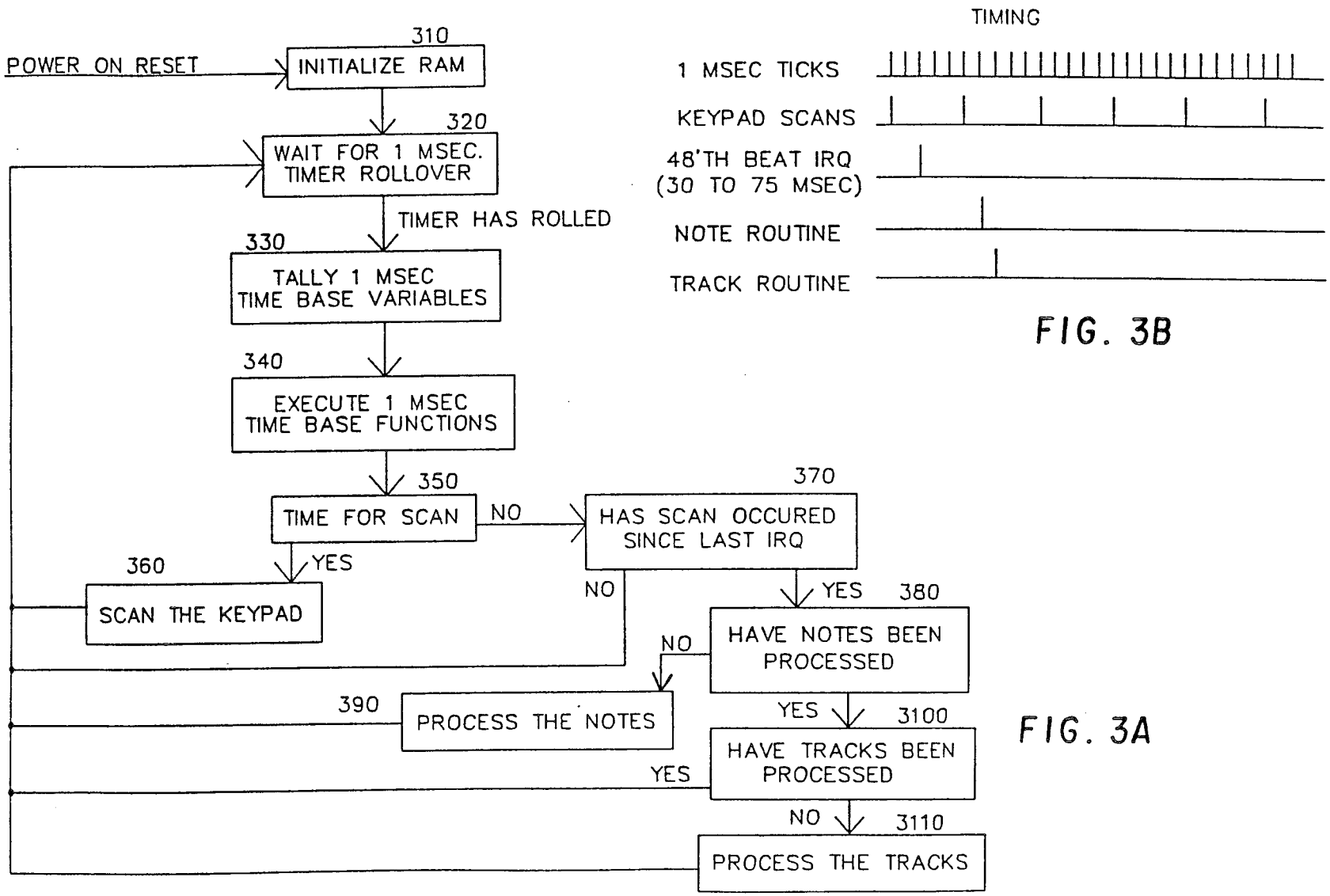
FIGS. 3A and 3B are a logic diagram of the main software loop and a timing diagram of the loop, respectively.

FIG. 3A is a logic diagram of the main software loop. In step 310, called on power up, all random-access-memory (RAM) is initialized by setting it to zero. The system then waits for the 1 msec internal timer (the next 1 msec tick in the timing figure) to roll over in step 320, then proceeds. In step 330 the 1 msec time base variables, including *scanenable* and *reston*, are updated. In step 340 the 1 msec time functions, vibrato and music off, are executed. (Software variables will be *italicized* for clarity. Important steps in this FIG. 3A are explained in more detail below.)

In step 350 *scanenable* is examined to determined whether a 5 msec rollover has occurred. If a 5 msec rollover has occurred, control branches to keyboard scan step 360. If it is not time for a keyboard scan, control branches to step 370. The music software (steps 380–390, 3100 and 3110) is executed once after the first key scan immediately following an IRQ. Accordingly, step 370 determines whether a key scan has occurred since the last IRQ. If yes, control branches to step 380 to execute the music software. If not, control returns to step 320.

In step 380 it is determined whether the notes have been processed since the last IRQ. If not, the manual notes are processed in step 390 and control returns to step 320. If the notes have been processed, control branches from step 380 to step 3100, which determines whether the preprogrammed tracks have been processed since the last IRQ. If not, the tracks are processed in step 3110 and control returns to step 320. If the tracks have been processed, control returns to step 320 directly from 3110. Thus, after the first keypad scan following each IRQ, the note processing step 390 and the track processing step 3110 each occur once in sequence, separated in time by 1 millisecond.

The timing relationships of the 1 msec ticks, the keypad scan s (step 360), IRQs, execution of the note routine (step 390), and the execution of the track routine (step 3110) are illustrated in the timing figure included in FIG. 3B. All routines called in the main loop are synchronized to the 1 msec time base and normally all possible paths in the main loop can be executed in less than 1 msec. This insures that the 1 msec time base integrity is kept intact.

Figure 4B:
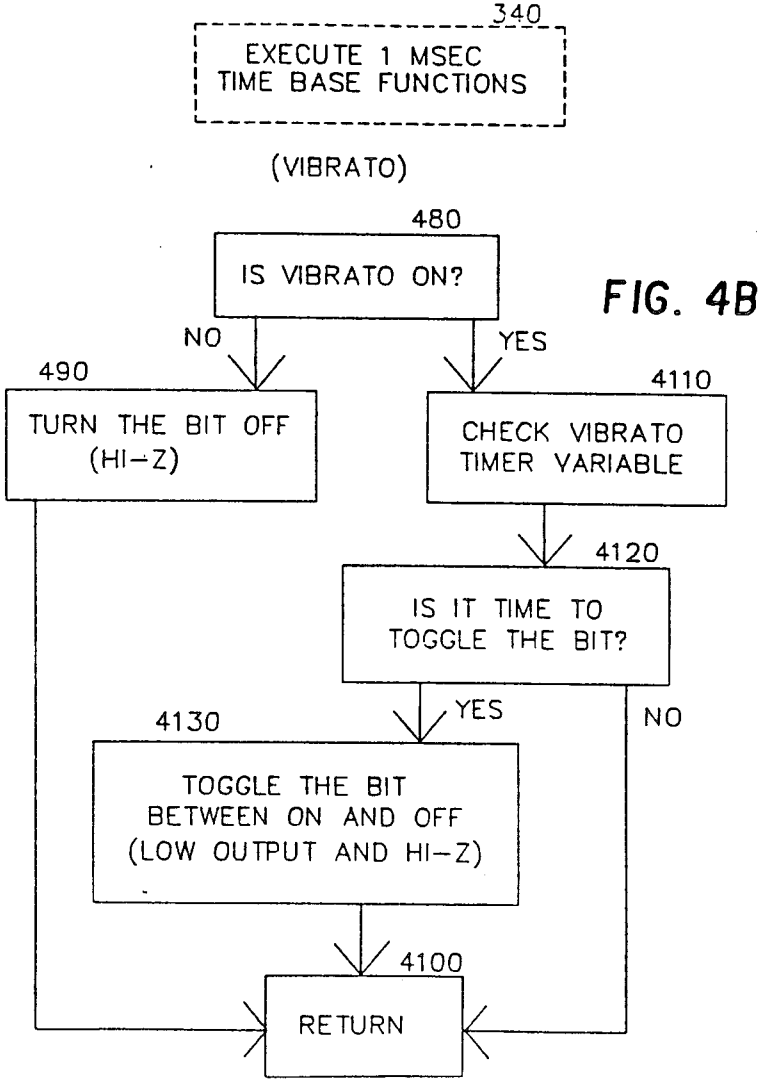
FIGS. 4A and 4B are detailed logic diagrams of steps 320, 330, and 340 of FIG. 3A.
Figure 4A:
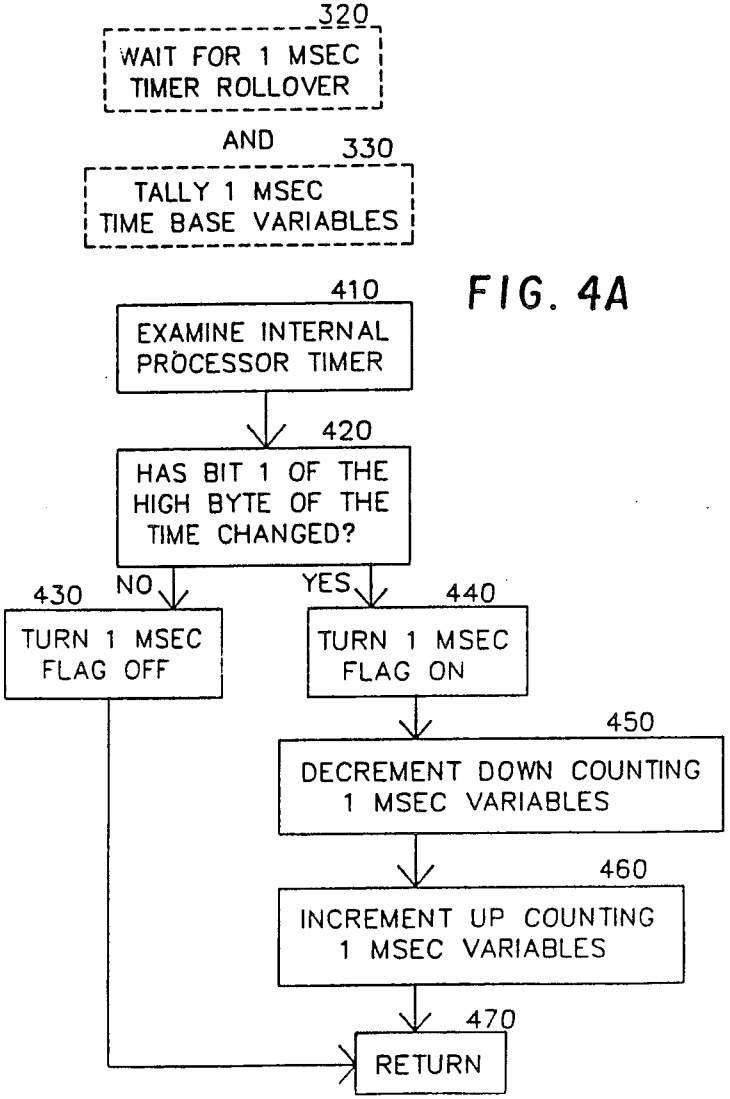
Figure 12:
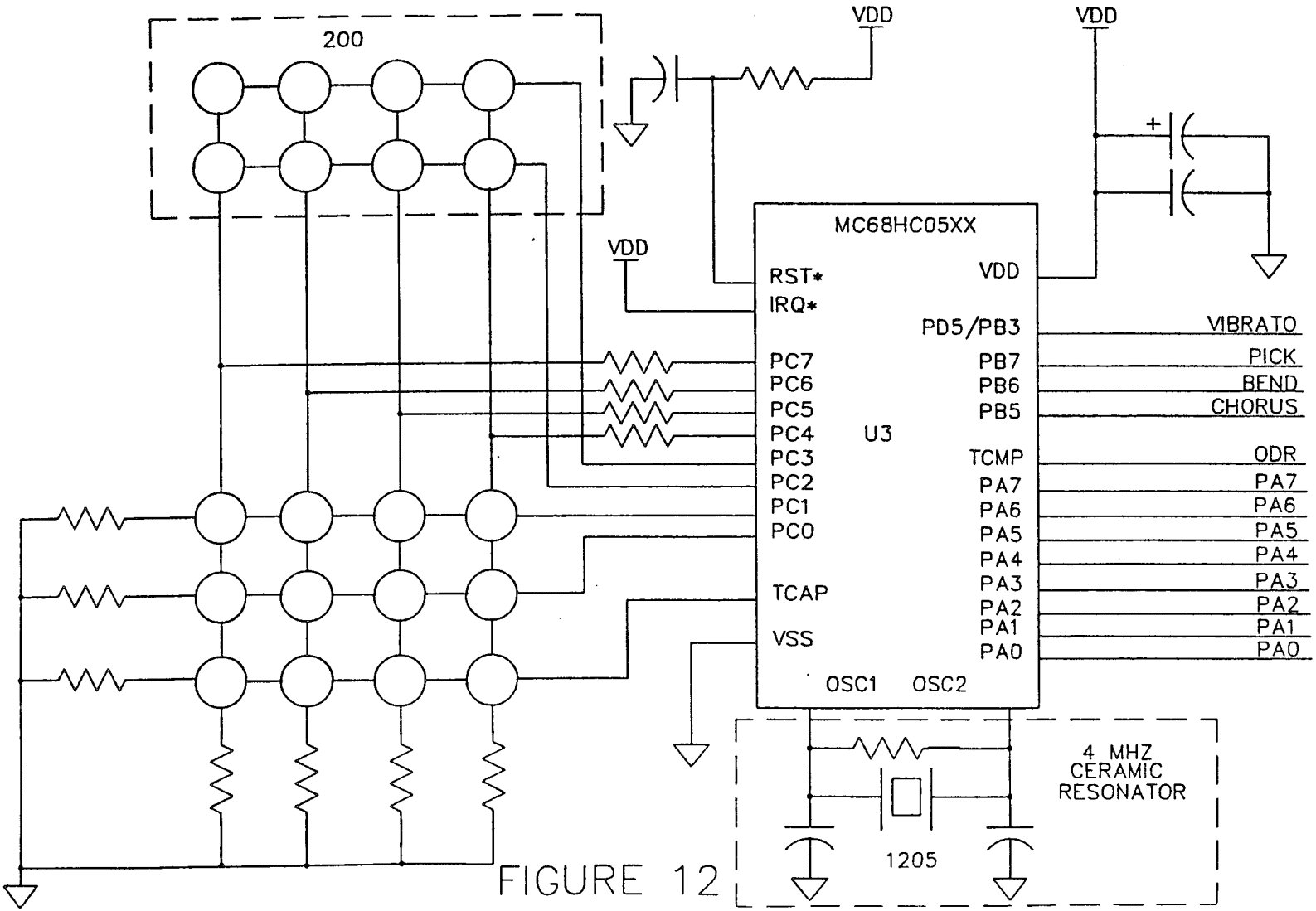
FIG. 12 is a detailed schematic of the keyboard 200, microprocessor 205, and ROM 210.

Steps 320, 330, and 340 of FIG. 3A are illustrated in detail in FIGS. 4A and 4B. In steps 410 and 420 the internal processor timer is examined. Specifically, bit 1 of the high byte of the internal timer is examined to see if it has changed. Every time this bit toggles corresponds to 1,024 msec. (A external 4 Mhz ceramic resonator is coupled to microprocessor 205 as illustrated in FIG. 12 to set this value.) If no change in the bit is detected, control branches to step 430, a 1 msec flag is turned off, and control branches back to step 410. Thus, once entered, this loop is exited only upon bit 1 of the high byte of the internal timer toggling.

When a change in bit 1 is sensed in step 420 control branches to step 440, the 1 msec flag is turned on, and control continues to step 450. In step 450 the 1 msec *reston* variable is decremented. Next, in step 460 the 1 msec *scanenable* variable is incremented. Control then returns to step 470.

After the return in step 470, control continues to a vibrato routine, step 340, which generates the vibrato effect. This step is illustrated in detail in steps 480–4130 of FIG. 43. A vibrato flag is examined in step 480. If the vibrato flag is disabled, control branches to step 490 and the VIBRATO signal (FIG. 2) is turned off by applying a high impedance ("hi-z") output to bend/vibrato circuit 245 (FIG. 2). Control then returns to step 4100. If the vibrato flag is enabled, control branches from step 480 to step 4110. In step 4110 a *vibrato timer* variable is incremented and compared to a threshold value. This software timer causes control to branch to step 4130 so that the VIBRATO signal toggles between a hi-z state and an active low output state at a rate of 5 Hz. If it is not time for the VIBRATO signal to toggle, control branches step 4100.

Figure 5:
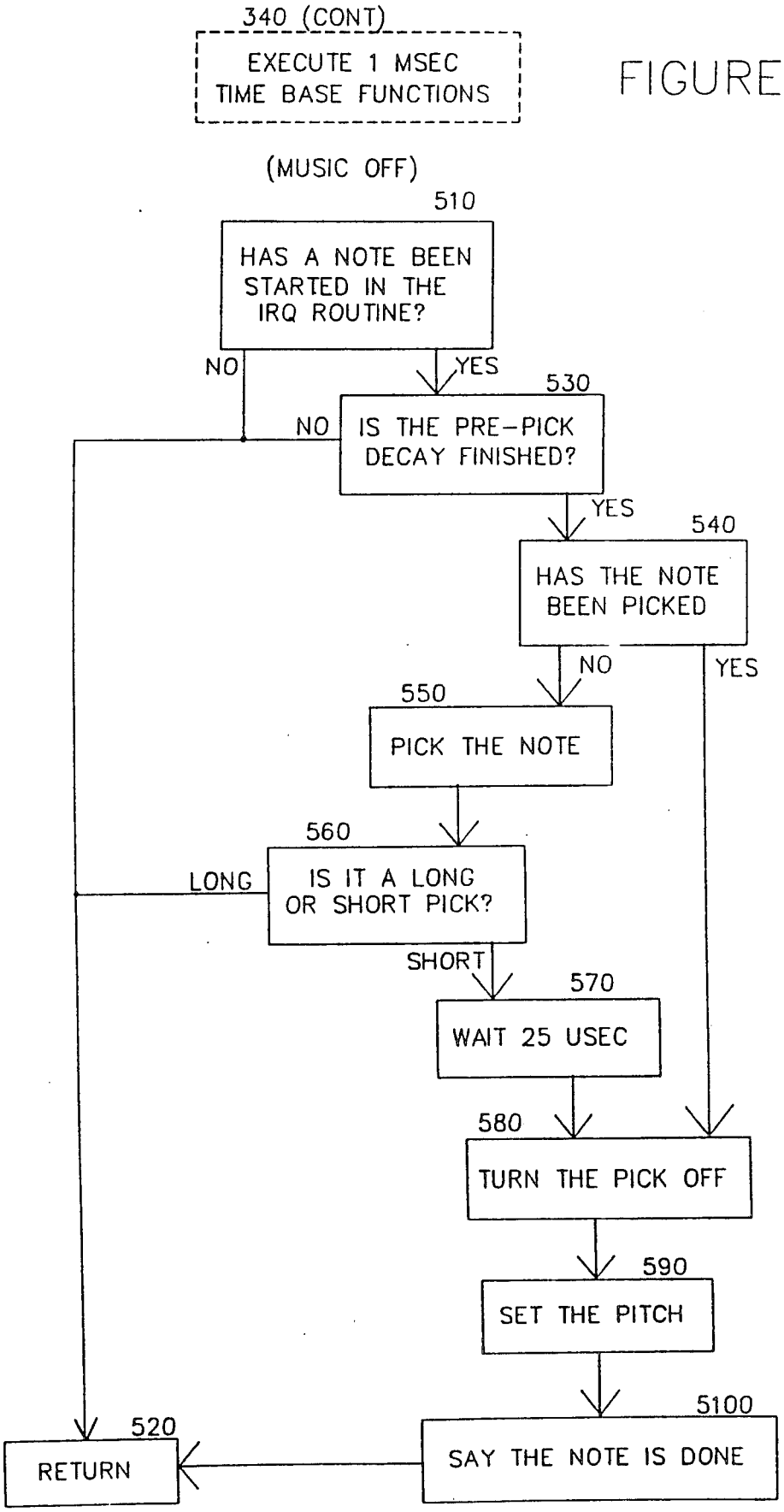
FIG. 5 is a detailed logic diagram of one of the 1 msec time base functions, "the music off routine".

After the return in step 4100, control continues to the other 1 msec time base function, music off, illustrated in detail in FIG. 5. The music off routine generates the PICK signal (FIG. 2) which drives envelope generator 225 (FIG. 2). The music off routine also generates the PITCH signal applied to DAC 215 (FIG. 2). Referring to FIG. 5, step 510 determines whether any new note was initiated in the IRQ routine by inspecting a *note-on* flag. If not, control returns to step 520. If yes, control branches to step 530 which determines whether the pre-pick decay is finished. (This is accomplished by examining *reston*, which nominally rolls over at 25 msec.) If not, control again branches to return, step 520. If the pre-pick decay is finished, control branches to step 540 which determines whether the note has been picked. If not, control branches to step 550 and the note is picked by setting the PICK signal applied to envelope generator 225 to an active high. The *picktype* variable is then examined in step 560 to determine whether it is a long or short pick. If long, control branches to return step 520. (The next time through the loop, the routine will turn off the PICK signal by setting it to Hi-z.) If short, control branches from step 560 to step 570, a delay loop of 25 usec is processed, and the PICK signal is turned off in step 580 by setting it to a hi-z. After the pick is turned off, the new PITCH signal as set up within the IRQ routine is applied to DAC 215 in step 590. Finally, in step 5100 the note-on flag is turned off. This disables this routine until after the next note is initiated by the IRQ routine which turns the *note-on* flag on.

Figure 6:
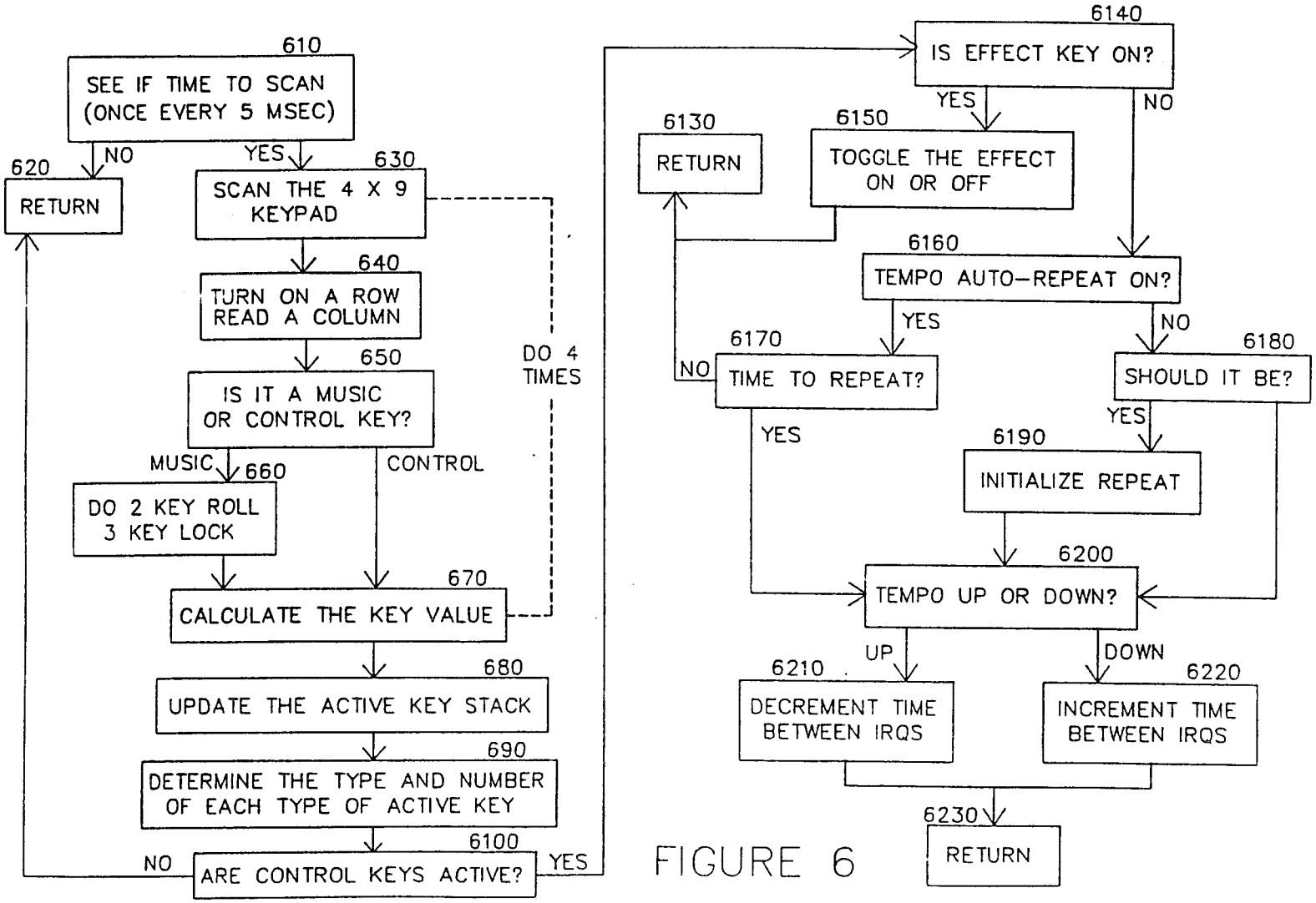
FIG. 6 is a detailed logic diagram of step 360, "the keypad scan routine".

The keypad scan routine, step 360 in FIG. 3A, is illustrated in detail in FIG. 6. This routine is executed once every 5 msec. In step 610 the *scanenable* variable is examined to determine whether it is time to scan. If not, control is returned to step 620. If it is time for another keypad scan, control branches to step 630. The keyboard scan is performed in a conventional manner by turning on one row of the keypad at a time. The sequence of steps 630–670 is repeated for each row. In step 640, a row is activated and the 5 bits of column data are read. The column data is then decoded to determine which, if any, of the five (5) keys are down. This process can uniquely determine two (2) active keys at a time. In step 650 the column is tested to see whether the column includes all music keys (105 and 110) or control keys (115, 120, 125 and 130). If it is a column of music keys, control branches to step 660. If it is a column of control keys, control branches to step 670.

In step 660 the music keys are processed in a conventional manner to provide a 2 key rollover and a three key lockout, which will provide information identifying up to two unique keys. An error flag is set if three (3) manual note keys 110 are pressed simultaneously. Otherwise, any third key pressed is ignored. In step 670 the column scan data for any active keys is converted to a number between 1 and 20 which uniquely identifies the active keys. Once the keypad is scanned, the type of each key (note, track or control), and the number of each type down is determined in step 680. Next, in step 690 the status of the active keys is placed in a stack. There are separate stacks for active note keys 110 and track keys 105 which provide a time history of up to two key events.

The time history of the key events is kept in order for the guitar to play "hammer-on" effects. After a key has been played, it must be "remembered" in case a following "hammer-on" note is later released. The most recent note key is always kept on top of the stack and the old note key is pushed up on the stack so that if the current note (the note on top of the stack) is released, the old value is recovered.

In step 6100 the stack is examined to see if any control keys are active. If not, control returns to step 620. If yes, control branches to step 6140 which determines whether an "effect key," chorus 130 or overdrive 125, is active. If yes, control branches to step 6150 and the corresponding effect is toggled by applying a CHORUS signal to chorus circuit 255 or a ODR signal to overdrive circuit 235 respectively. Control then returns to step 6130.

If no effect key is on in step 6140 control branches to step 6160. Steps 6160–6220 implement the tempo up 120 ands tempo down 115 in a convention manner which includes an auto repeat feature if either key is held down. The tempo is adjusted by modifying the time between IRQs.

Figure 7:
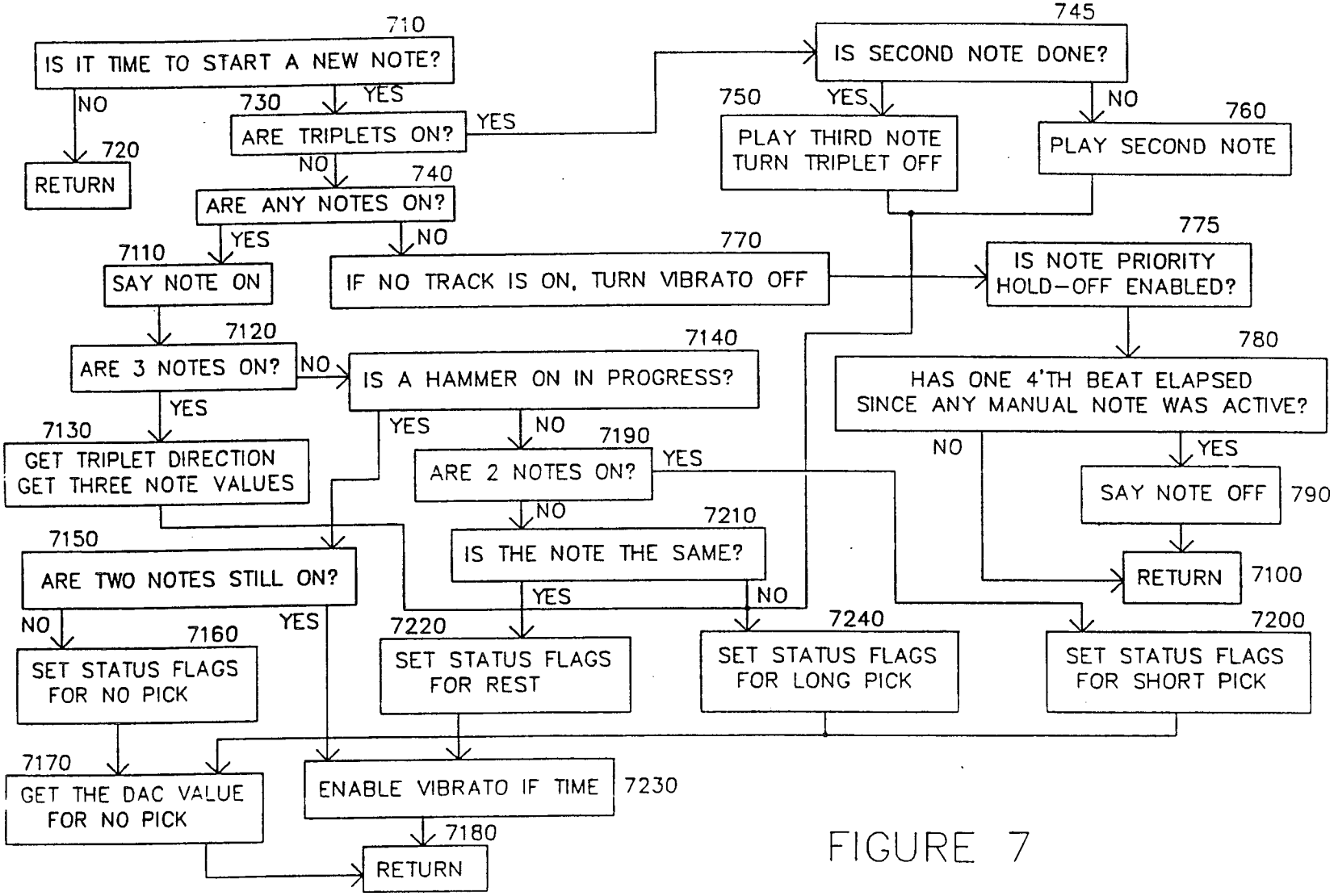
FIG. 7 is a detailed logic diagram of step 390, "process the notes".

Step 390, process the notes, is illustrated in detail in FIG. 7. In step 710 a test is made to see if a triplet note is still active. If yes, no new note is started and control returns to step 720. If a new note can be started, control branches to step 730. In step 730 the triplet flag is examined to determine if any notes are left to be played in a triplet. If yes, control branches to step 745, and a test is made to determine whether the next note of the triplet to be played is the second note. If it is the second note, control branches to step 760. If it is not the second note (which means that it is the third note), control branches to step 750. In step 750 the triplet flag is turned off and the third note is retrieved from memory. (They are stored in step 7130.) In step 760 the second note is retrieved from memory.

Control continues from either step 750 or step 760 to step 7240. In step 7240 the *picktype* variable is set to long pick. Control then continues to step 7170, where the note value is stored in the *old-note* variable, and is converted to the DAC value by referencing a look-up table in ROM 210. The DAC value is stored as the *pitch* variable. Control then returns to step 7180.

If no triplets are on in step 730, control branches to step 740. In step 740, the stack is examined to determine whether any notes are active. If yes, control branches to step 7110. In step 7110 the note priority flag is turned on and the priority count enable flag is turned off. Control then continues to step 7120. The stack is examined in step 7120 to determine whether three (3) manual notes are on simultaneously. If yes, control branches to step 7130. In step 7130 a triplet is initialized by putting the appropriate note values in memory and setting the triplet flag on. Control then continues to step 7240 explained above.

If three (3) notes are not on in step 7120, control continues to step 7140. The hammer flag is examined to determine whether a "hammer on" is in progress. If yes, control proceeds to step 7150. In step 7150 the stack is examined to determine whether two notes are on simultaneously. If yes, control proceeds to step 7230. In step 7230 the vibrato time variable is examined to see if it is time to turn on the finger vibrato effect. The vibrato flag is turned on if it is time. Control then continues to step 7180.

If only one note is on in step 7150, control branches to step 7150. In step 7150 the *picktype* variable is set to no-pick and the note value is set to the current note. Control then continues to step 7170, described above.

If no hammer-on was detected in step 7140, control proceeds to step 7190. In step 7190 the stack is examined to see if 2 notes are on simultaneously. If yes, control branches to step 7200. In step 7200 the hammer flag is turned on, the *picktype* variable is set to short, and the note value is set to the current note. Control then continues to step 7170, described above.

If only one note is on in step 7190, control branches to step 7210. In step 7210 the current note is compared to the *old note* variable. If they are the same, control branches to step 7220. In step 7220, the *picktype* variable is set to off, and control continues to step 7230, described above. In step 7220, if the note is not the same, note value is set to the current note, and control continues to step 7240, described above.

In step 740, if no notes are on control branches to step 770. In step 770 the track on flag is examined. If not on, the vibrato enable flag is turned off. Control then continues to step 775 and a priority count enable flag is examined. If off, the *priority-count* variable is initialized, the flag is turned on, and control continues to step 780. If the priority count enable flag is on, control continues directly to step 780. In step 780 the *priority-count* variable is examined to see if a quarter beat has elapsed since the last manual note was released. If true, control branches to step 790, where the note priority flag is turned off, and control continues to step 7100. If a quarter beat has not elapsed in step 780, control returns to step 7100.

Figure 8:
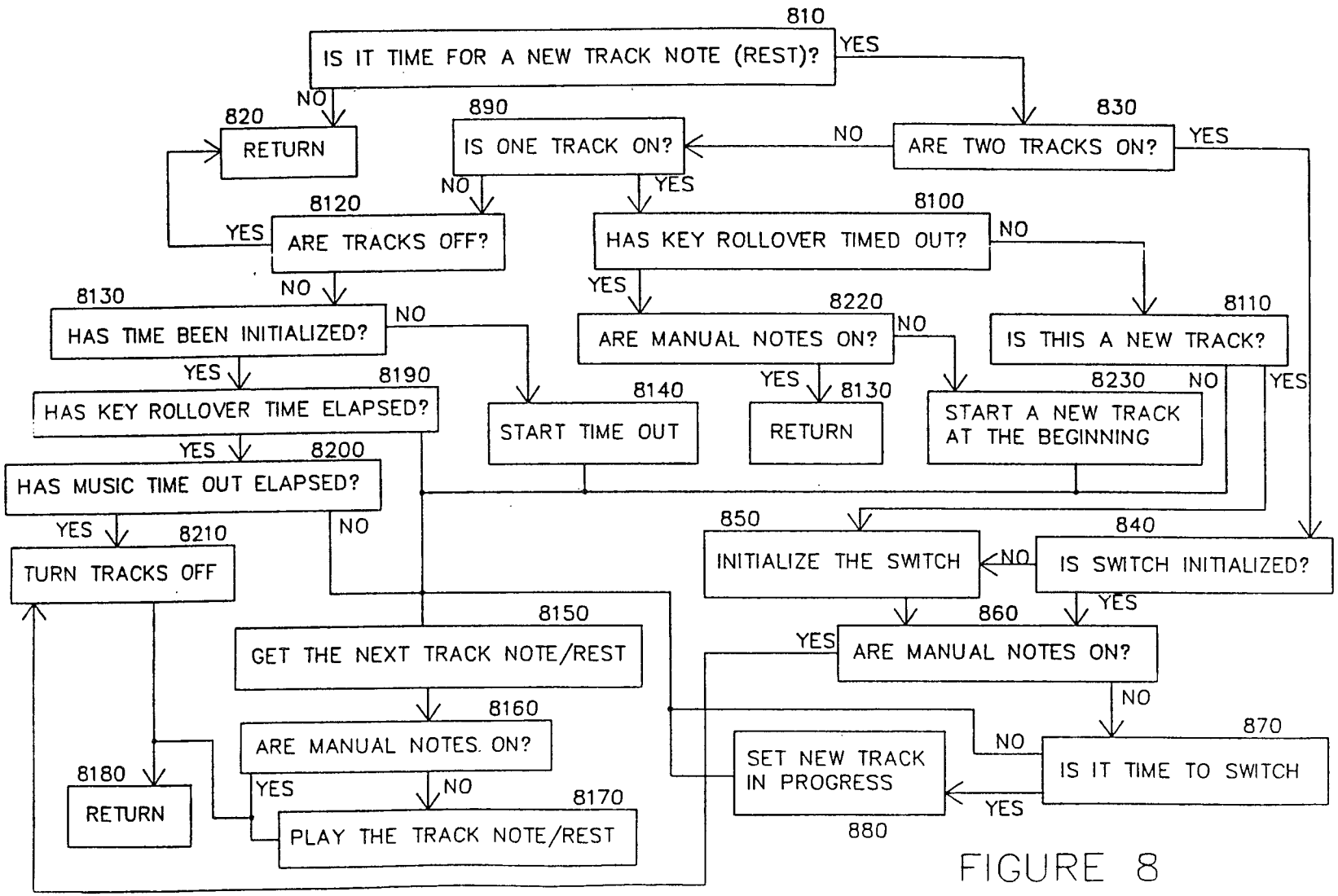
FIG. 8 is a detailed logic diagram of the track processing routine 3110.

The track processing routine 3110 is illustrated in detail in FIG. 8. Step 810 examines a track time variable to determine if a new track note or rest may be started. If not, the routine is exited at step 820. If yes, the number of track keys down is checked in step 830. If two (2) are on simultaneously, a track switch flag is examined to see if a track switch has been initialized in step 840. If not, the track switch is initialized in step 850 and the track switch flag is turned on. Control then continues to step 860. If the track switch flag was on in step 840, control branches to step 860.

In step 860, the note priority flag is examined to see if a manual note is active. If yes, control branches to step 8210 where the track flag is set to indicate that tracks are off. Control then continues to step 8180. If manual notes are off in step 860, control branches to step 870 where the *current-beat-time* variable is compared to the *next-quarter-beat-time* variable (discussed in the detailed explanation of step 850) to determine whether it is time to switch tracks. If yes, control branches to step 880 where the track pointer is switched to the new track and control continues to step 8150. In step 8150 the next track item (note, rest or command) is loaded from a track table and control proceeds to step 8160. In step 8160 the note priority flag is examined. If on, control branches to step 8180. If off, control branches to step 8170, the new track item is played, and control continues to step 8180.

If two tracks are not on in step 830, control branches to step 890. In step 890, a test is made to see if one track is on. If yes, control branches to step 8100 where the *key-rollover-timer* variable, set in step 8140, is checked to see if an eighth of a beat has elapsed since no track keys were down. If not, control branches to step 8110 where the current track is compared to the old track. If the current track is the same as the old track control branches to step 8150, described above. If the tracks are different, control branches to step 850, described above.

In step 8100, if the *key-rollover-timer* variable has timed out, control branches to step 8220. In step 8220 the note priority flag is examined to see if a manual note is on. If on, control branches to step 8180. If off, control branches to step 8230 where a track is started from the beginning and the old track variable is set to the current track. Control then continues to step 8150, described above.

In step 890, if no track keys are on, control branches to step 8120 where the track flag is examined to see if the tracks are off. If tracks are off, control branches to step 820. If the track flag is on, control branches to step 8130 where the track flag is examined to determine if the *key-rollover-timer* variable and track off time have been initialized. If not, control branches to step 8140 where the *key-rollover-timer* variable is initialized, the track-off time is initialized, the current track is set equal to the old track variable, and control continues to step 8150.

In step 8130, if the rollover and track off time have been initialized, control branches to step 8190. In step 8190 the current track is set equal to the *old track* variable and the *key-rollover-timer* variable is checked. If it has not elapsed, control branches to step 8150. If it has elapsed, control branches to step 8200 where the track-off time is checked. If the time has not elapsed, control passes to 8150. If the time has elapsed, control branches to step 8210, described above.

Figure 9:
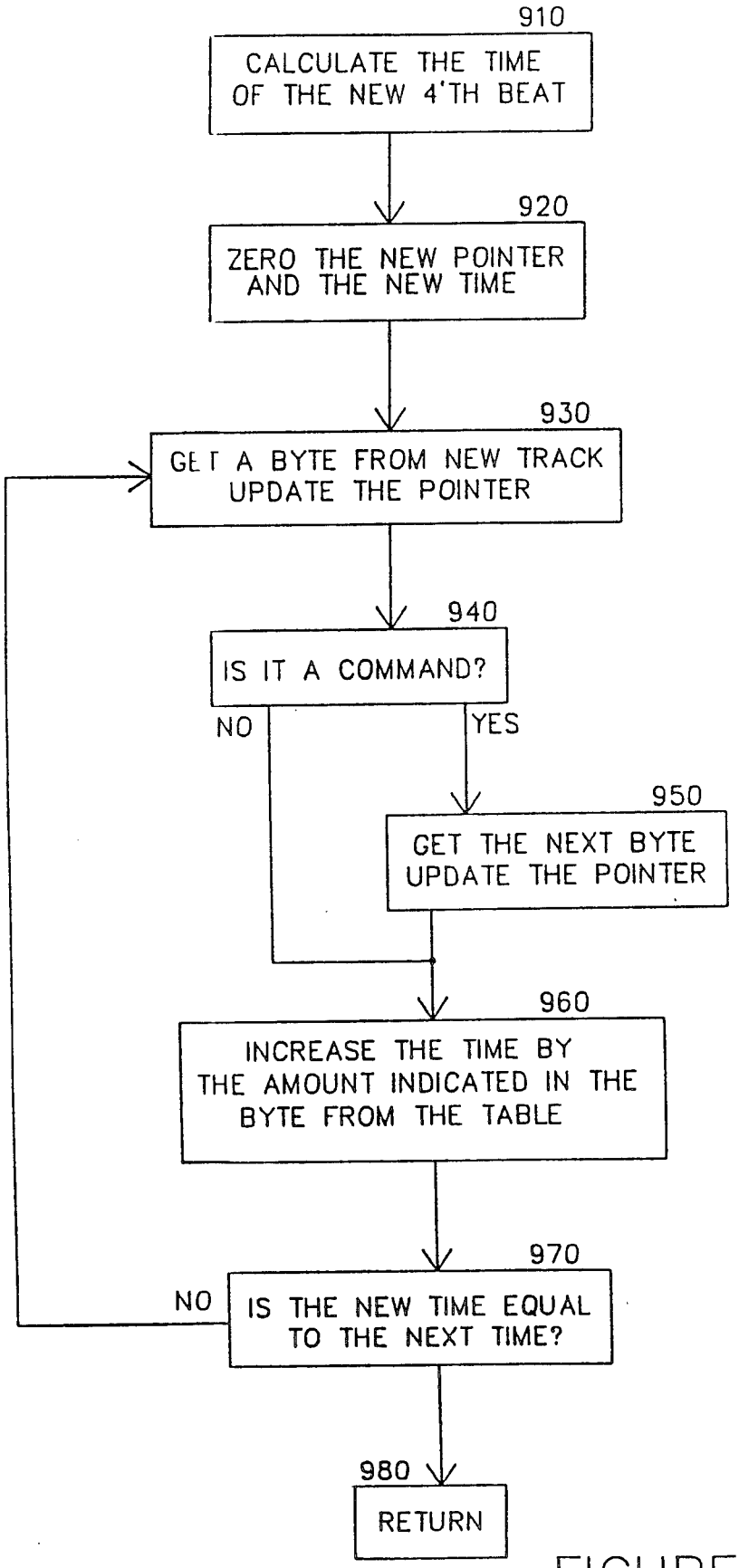
FIG. 9 is a detailed logic diagram of step 850 from FIG. 8.

FIG. 9 is a detailed illustration of the logic in step 850 from FIG. 8. In step 910 the next *quarter-beat-time* variable is calculated by taking "mod 12" of the *current-beat-time* variable, adding 1 to the result, and multiplying by 12. Control then proceeds to step 920 where the new track pointer is set to zero and a new *current-beat-time* variable is set to zero. Control then proceeds to step 930, where the first byte is retrieved from the new track and the new track pointer is incremented. Control then proceeds to step 940 where the byte from the table is tested to determine if it is a command or a note/rest. If it is a command, control branches to step 950 where the next byte from the table is loaded and the new track pointer is incremented. Control then proceeds to step 960. In step 940, if the byte was a note/rest, control branches to 960. In step 960, the duration of the note/rest is extracted from the byte and is added to the new *current-beat-time* variable. Control then proceeds to step 970 where the next *quarter-beat-time* variable is compared to the *new-quarter-beat-time* variable. If not equal, control loops to step 930. If equal, control returns to step 980.

Figure 10:
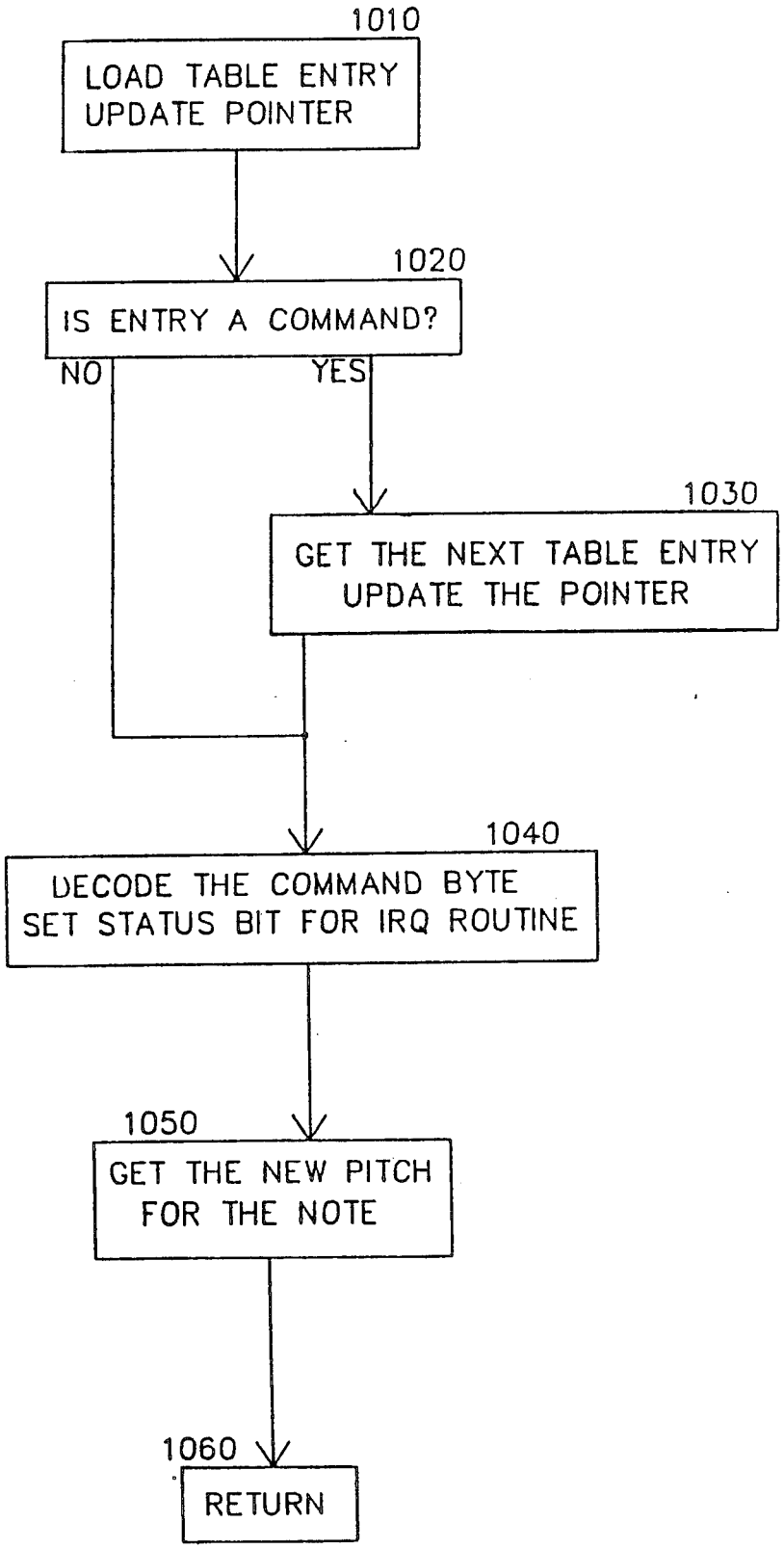
FIG. 10 is a detailed logic diagram of step 8170 from FIG. 8.

FIG. 10 is a detailed illustration of the logic of step 8170 from FIG. 8. Step 1010 loads the current track byte and increments the current track pointer. Control proceeds to step 1020 where the current byte is tested to determine whether it is a command. If not, control branches to step 1040. If a command, control branches to step 1030 where the next byte is fetched from the table and the current track pointer is incremented. Control then proceeds to step 1040. The track command byte is decoded, appropriate status bits are set in the command-byte variable, and the track-note byte is decoded to determine the duration of the note/rest. The duration is saved as the *track-time* variable. Control then proceeds to step 1050 where the remainder of the track-note byte is decoded to determine the DAC value of the note to be played. (This information will be processed by the IRQ routine.) Control then proceeds to step 1060.

The IRQ routine is executed independently of the main loop in response to every IRQ. IRQs are generated when the internal timer of microprocessor 205 matches a value in the internal timer-compare register. The value in the timer compare register determines the tempo of the guitar and is modified by the tempo keys as described above. The IRQ occurs once every 28–67 msec as determined by the tempo controls.

Figure 11:
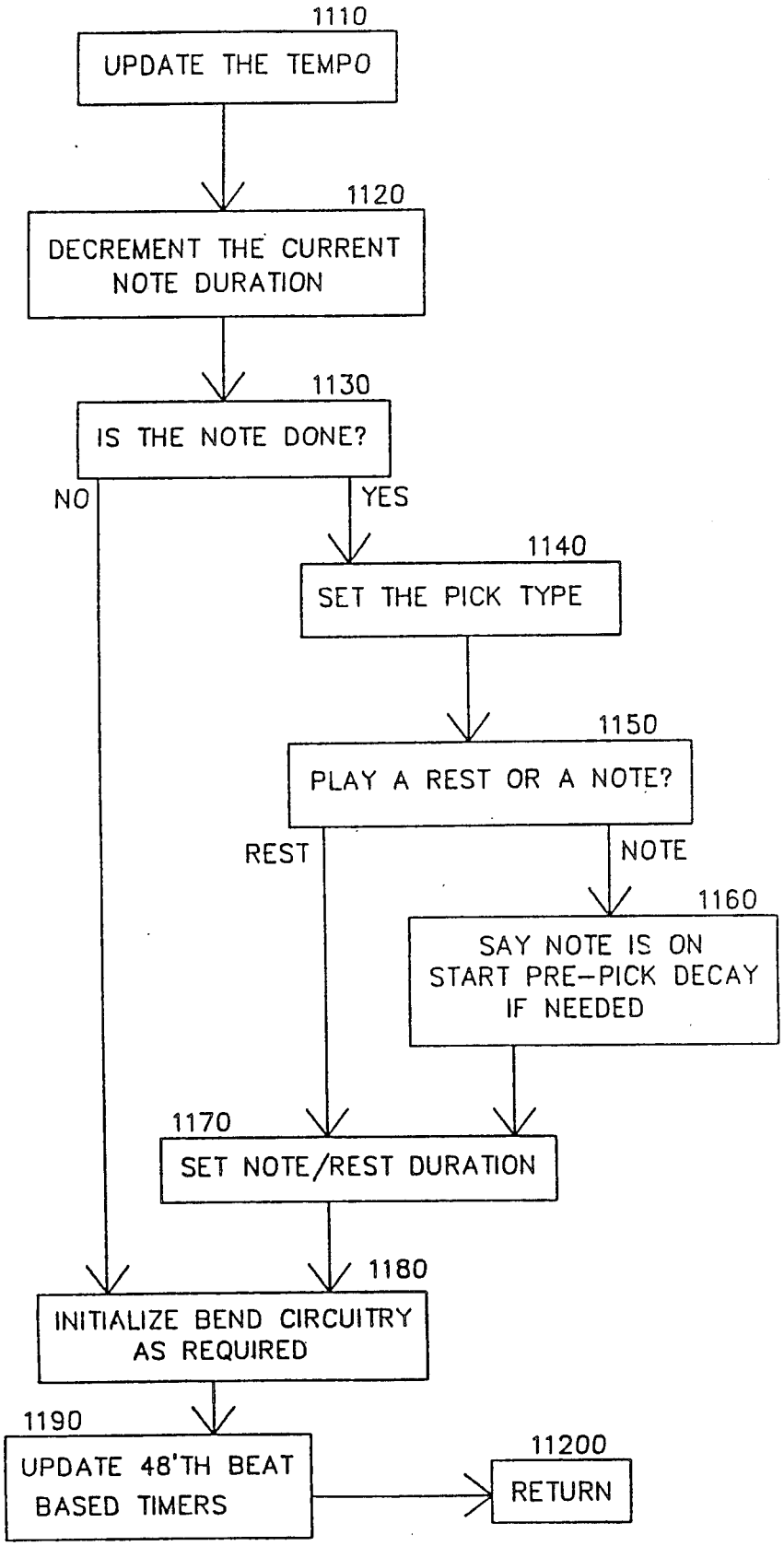
FIG. 11 is a detailed logic diagram of the IRQ routine.

FIG. 11 is a detailed illustration of the logic of the IRQ routine. In step 1110, the internal timer compare register is updated and control proceeds to step 1120. The *event-duration* variable is decremented and control proceeds to step 1130 where the *event-duration* variable is examined to see if the current event is done. If done, control branches to step 1140. In step 1140 the bits of the command byte are examined to step the appropriate pick for the note to be played and control branches to step 1150. In step 1150, the command byte is tested to determine whether a note or a rest is to be played. If a note, control branches to step 1160. In step 1160, the PICK signal (FIG. 2) is set to an active low and the note-on flag is turned on. Control proceeds to step 1170. In step 1150, if a rest is being played, control branches to step 1170. In step 1170, the duration of the current item is transferred to the *event-duration* variable, the DAC value for the new pitch is loaded from the *pitch* variable into the *new pitch* variable, and control proceeds to step 1180. In step 1130, if the note is not done, control branches to step 1180 where the command byte is tested to see if a bend is to be implemented. If so, the BEND signal is applied to bend/vibrato circuit 245 (FIG. 2) and control continues to step 1190. If no BEND signal is required, control proceeds directly to step 1190. In step 1190 the *current quarter-beat-time* variable is incremented and control proceeds to step 11200.

Finally, a "guitar off" routine is provided, which is not illustrated. In this routine, the presence of all keys is monitored. If no key is depressed from 10–20 seconds, the pitch of the guitar is set to zero. This causes the output of DAC 215 to go to zero which quiets any residual audio sound. If this state of inactivity continues, the guitar will play one fourth beat of the first score every two (2) to five minutes in order to remind the user that the power is still on.

The Digital Music

The music for the preprogrammed tracks is stored in ROM 210 in a compacted byte format. Bytes in the table are either command bytes (contain no time information) or music bytes (contain time information.) Command bytes are not consecutively placed within one track of the score. Upon playing the first byte of any track or the play of the first byte of a track after switching between tracks, bend and vibrato are automatically turned off. Otherwise, the bend and vibrato are turned on and off with commands as required.

There are six (6) commands:

01H—unbend voiced
21H—minor bend
41H—major bend
61H—unbend quiet
81H—vibrato off
A1H—vibrato on Unbend voiced is executed immediately after the note is picked. This is usually preferred for the case of a bend down in the score or the case of consecutive bend ups. In the case of consecutive bend ups, the bend up note must be translated from a timing stand point. Usually into 8th or 16th notes and a final 8th beat triplet. The unbend is inserted in between the last two notes of the triplet.

The unbend quiet command is executed immediately in the IRQ routine before the note is picked. It is usually preferred in the case of recovering from a bend up in order to play the next note which is unbent. Both unbend quiet and voiced commands return the BEND signal to a logic low output. The time at which the output is returned to low is varied making the unbend quiet command less audible.

A minor bend command switches the BEND signal to generate an increase in the VBIAS voltage by switching to a Hi-z state. This causes the pitch to increase slowly by a half step.

A major bend command switches the BEND signal to its high state to generate an increase in the VBIAS voltage. This causes the pitch to increase slowly by a whole step.

The vibrato off command turns the VIBRATO output low to stop the vibrato effect.

The vibrato on command causes the VIBRATO output to oscillate at approximately 5 Hz to create a vibrato effect.

The bits of the music bytes in the compacted byte format are defined as follows:

| | |
|---|---|
| Bit 7: | 1 indicates a picked note.<br>0 indicates an unpicked note.<br>(Rests may be picked or not.) |
| Bits 6 & 5: | 11 indicates a duration of 6, or ⅛ of beat.<br>10 indicates a duration of 4, or 1/12 of a beat<br>01 indicates a duration of 32, or 1/16 of a beat<br>00 indicates a duration of 2, or 1/24 of a beat<br>(The 1/12 and 1/24 notes are provided to make quarter and eighth note triplets possible.) |
| Bits 4–0: | 00000 indicates a rest<br>00001 indicates a command byte<br>00010–11111 indicates a note which is derived from the note tables. (00010 binary is converted to 2–31 decimal.) |

Table 1 illustrates the correspondence between guitar notes and the values corresponding to bits 4–0 in the music bytes. For each string (E,B,G, etc.) the leftmost column corresponds to the guitar tabulature, the center column to the value of the note, and the number in the right most column is the decimal value of the number to be inserted in bits 4–0 of the corresponding music byte. The preferred embodiment of the present invention provides thirty (30) notes in the middle and upper registers of a guitar. The overall tuning of this range of pitch can be varied by means of pitch control 135 illustrated in FIG. 1. Tuned to the highest pitch (or key) the range of notes is the chromatic scale from G-3 (196 Hz) to C-6 (1047 Hz).

TABLE 1

| E string (top) | | | B string | | | G string | | | D string | | | A string | | | E string (bottom) | | |
|---|---|---|---|---|---|---|---|---|---|---|---|---|---|---|---|---|---|
| 5 | A | 16 | 5 | E | 11 | 5 | C | 7 | 5 | G | 2 | | | | | | |
| 6 | Bb | 17 | 6 | F | 12 | 6 | Db | 8 | 6 | Ab | 3 | | | | | | |
| 7 | B | 18 | 7 | Gb | 13 | 7 | D | 9 | 7 | A | 4 | | | | | | |
| 8 | C | 19 | 8 | G | 14 | 8 | Eb | 10 | 8 | Bb | 5 | | | | | | |
| 9 | Db | 20 | 9 | Ab | 15 | 9 | E | 11 | 9 | B | 6 | | | | | | |
| 10 | D | 21 | 10 | A | 16 | 10 | F | 12 | 10 | C | 7 | 10 | G | 2 | | | |
| 11 | Eb | 22 | 11 | Bb | 17 | 11 | Gb | 13 | 11 | Db | 8 | 11 | Ab | 3 | | | |
| 12 | E | 23 | 12 | B | 18 | 12 | G | 14 | 12 | D | 9 | 12 | A | 4 | | | |
| 13 | F | 24 | 13 | C | 19 | 13 | Ab | 15 | 13 | Eb | 10 | 13 | Bb | 5 | | | |
| 14 | Gb | 25 | 14 | Db | 20 | 14 | A | 16 | 14 | E | 11 | 14 | B | 6 | | | |
| 15 | G | 26 | 15 | D | 21 | 15 | Bb | 17 | 15 | F | 12 | 15 | C | 7 | 15 | G | 2 |
| 16 | Ab | 27 | 16 | Eb | 22 | 16 | B | 18 | 16 | Gb | 13 | 16 | Db | 8 | 16 | Ab | 3 |
| 17 | A | 28 | 17 | E | 23 | 17 | C | 19 | 17 | G | 14 | 17 | D | 9 | 17 | A | 4 |
| 18 | Bb | 29 | 18 | f | 24 | 18 | Db | 20 | 18 | Ab | 15 | 18 | Eb | 10 | 18 | Bb | 5 |
| 19 | B | 30 | 19 | Gb | 25 | 19 | D | 21 | 19 | A | 16 | 19 | E | 11 | 19 | B | 6 |
| 20 | C | 31 | 20 | G | 26 | 20 | Eb | 22 | 20 | Bb | 17 | 20 | F | 12 | 20 | C | 7 |
| | | | 21 | Ab | 27 | 21 | E | 23 | 21 | B | 18 | 21 | Gb | 13 | 21 | Db | 8 |
| | | | 22 | A | 28 | 22 | F | 24 | 22 | C | 19 | 22 | G | 14 | 22 | D | 9 |

The Digital Multitrack Score

The preferred embodiment of the present invention incorporates eight (8) compatible musical tracks and eight (8) musical notes in each of two alternate scores. The musical tracks function somewhat like the scrolls in a player piano, only they may be switched in or out by pressing track buttons 105 on the neck of the guitar. All tracks within a score are in the same key and the guitar playing style within a score is consistent. This helps to improve the smoothness of track switching. Specifically, the eight tracks have been written using C major, C minor, and C pentatonic scales with the manual notes belonging only to the C pentatonic scale. This produces a good musical sound with a blues/rock flavor. Use of the pentatonic scale provides a "can't goof" compatibility between the tracks and the notes.

Each of the eight (8) musical tracks is composed of eitht, four measure bars of 4/4 time, or sixteen (16) beats long. The tracks are composed so that switching between tracks at the quarter beat results in musically reasonable transitions. When the player switches from one track to another, the guitar synchronizes the time of the switch to the next quarter beat. In this way, any track may be entered at any quarter beat point in time. The overall beat and absolute time are maintained by the guitar. In this way, a small amount of music may be replayed in a large number of variations. As long as a track key is held down, the track will play. When the end of the track is reached, it is repeated from the start. Both bend and vibrato are turned off when a switch is made or the current track is restarted.

Details of the Electronics

FIG. 12 is a detailed schematic of keyboard 200 and microprocessor 205. Keyboard 200 is coupled to microprocessor 205 in a conventional manner through input lines PCO-PC7 and PDO. A 4 Mhz ceramic resonator circuit 1205 is coupled to the oscillator pins OSC1 and OSC2 of microprocessor 205 to control the internal timer. Microprocessor 205 provides VIBRATO, PICK, BEND, CHORUS, and ODR signals as described in conjunction with FIG. 2, and provides a PITCH signal to DAC 215 via pins PA0-PA7. ROM 210 is internal to the 6805 microprocessor 205.

Figure 13:
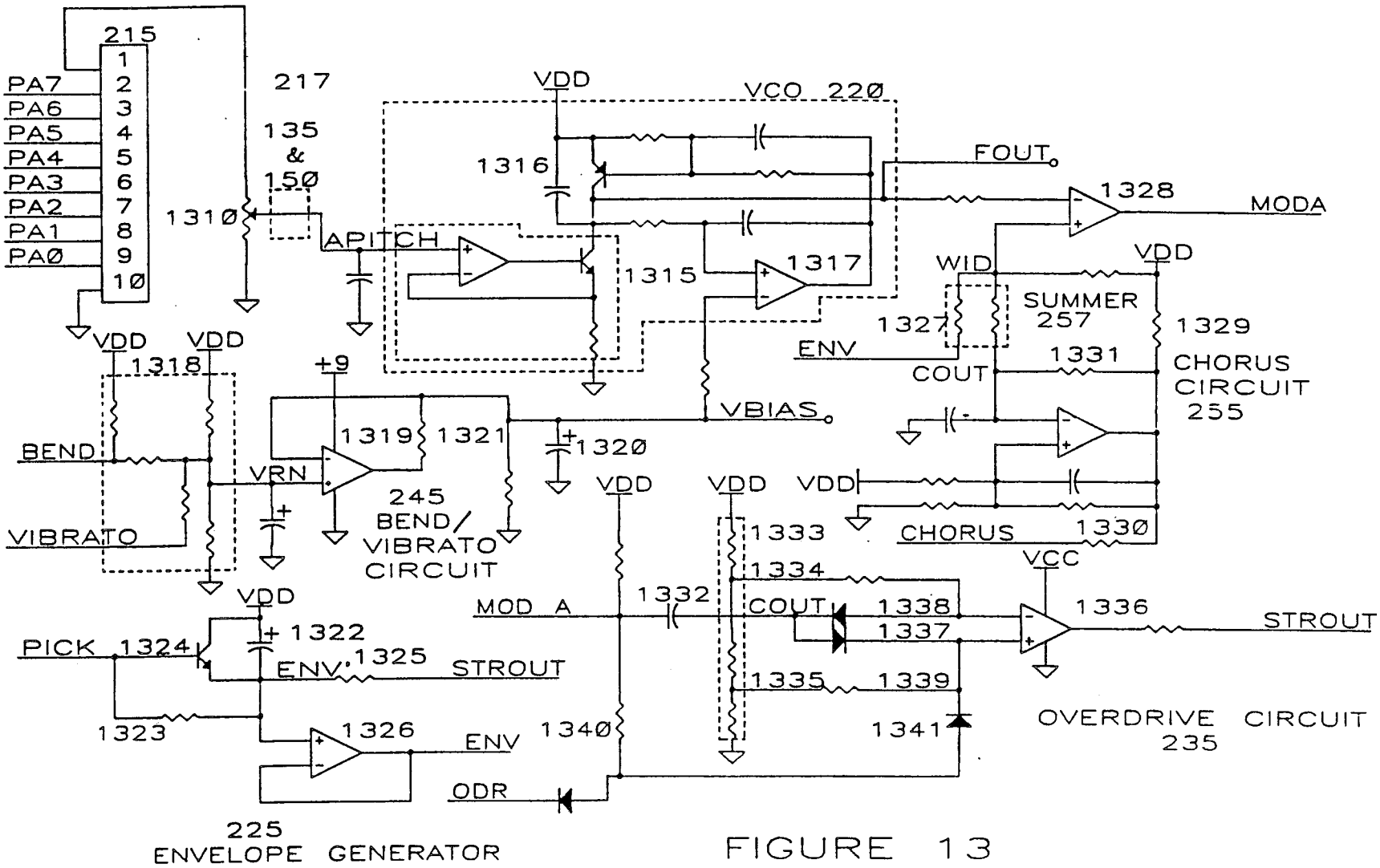
FIG. 13 is a detailed schematic diagram of the digital-to-analog converter, VCO, bend/vibrato circuit, envelope generator, overdrive circuit and chorus circuit.
Figure 14:
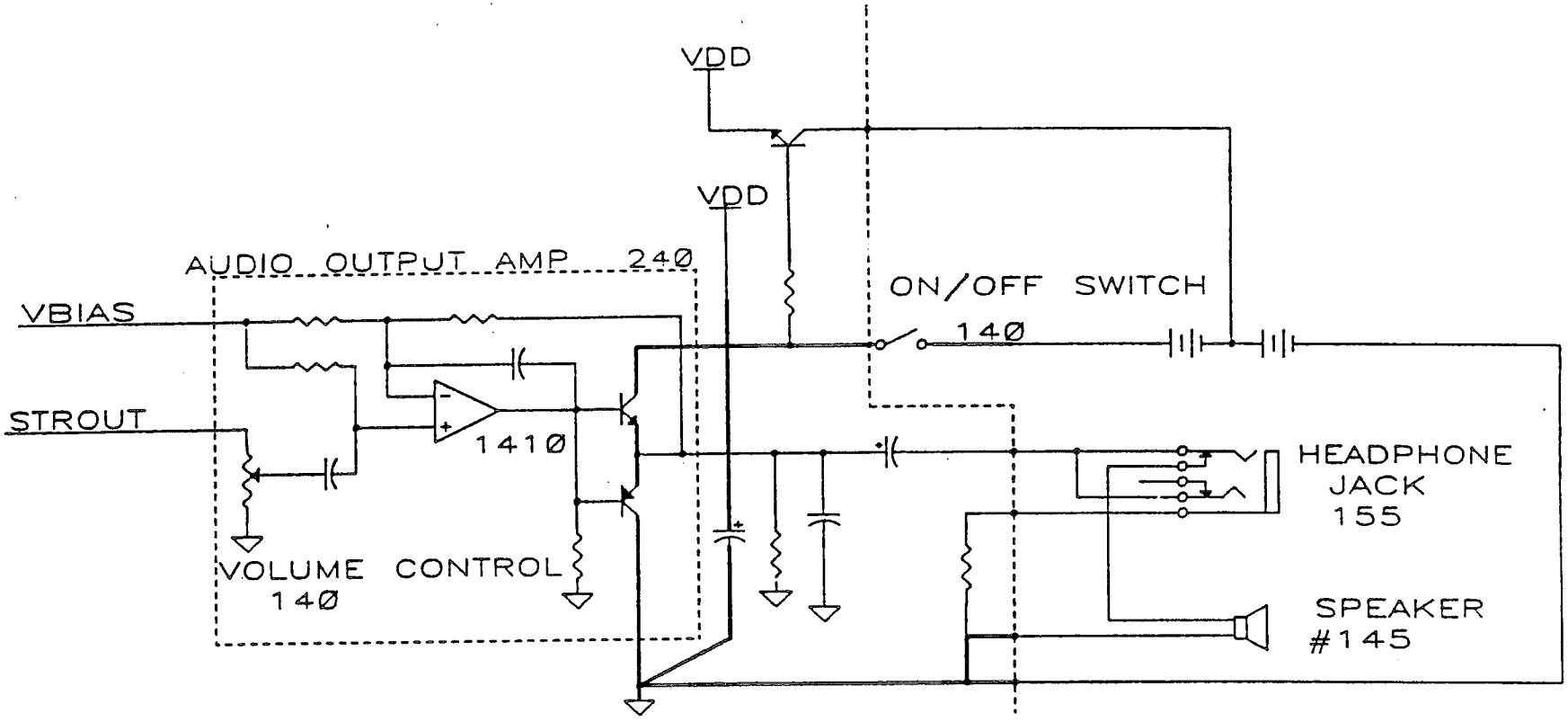
FIG. 14 is a detailed schematic diagram of the audio output amplifier.

Referring to FIGS. 13 and 14, an eight bit digital-to-analog converter (DAC) 215, is coupled to microprocessor 205 via lines PAO-PA7. DAC 215 is loaded through these lines with the PITCH signal, a binary number corresponding to the frequency of the note to be played. The PITCH signal from microprocessor 205 has a Hi-z type output and thus has a voltage swing close to the power and ground voltages. DAC 215 comprises a R-2R resistor ladder 1305 coupled between ground and the PITCH signal which provides an analog signal at pin 1 proportional to the binary value of the PITCH signal times the power voltage VDD.

This analog signal is applied to pitch reference circuit 217 which comprises a variable resistor 1310. The analog signal from pin 1 of DAC 215 is divided by a variable resistor 1310 which is controlled manually by pitch control 135 and tremolo bar 150. The resulting analog signal, APITCH, is coupled to sawtooth waveform VCO 220.

The voltage APITCH from pitch reference circuit 217 applied to VCO 220 is coupled to a conventional current sink circuit 1315 which functions to draw a current from capacitor 1316 proportional to the voltage of APITCH. This causes the voltage on timing capacitor 1316, FOUT, to ramp toward the ground voltage at a slope proportional to the input voltage APITCH. When FOUT falls below the reference voltage VBIAS, comparator 1317 fires and discharges timing capacitor 1316 bringing the voltage FOUT back up to VDD. The overall function of VCO 220 is to generate a negative going sawtooth waveform that ramps from VDD to VBIAS with a slope proportional to voltage APITCH. The frequency of the sawtooth wave FOUT is proportional to the voltage of APITCH times the voltage difference between VDD and VBIAS. Further, if VBIAS is set as a fixed proportion of VDD, the frequency of FOUT is proportional to the digital signal PITCH independent of variations in VDD.

Variable resistor 1310 changes the analog voltage APITCH applied to VCO 220 as a percentage of the analog signal from pin 1 of DAC 215, which is proportional to the voltage of the PITCH signal and the power supply. Thus the change in pitch due to actuation of pitch control 135 and tremolo bar 150 multiplies the pitch of the note, which produces a realistic effect, and unaffected by changes in the power supply voltage VDD.

The reference voltage, VBIAS, is generated to be proportional to the power supply voltage VDD in order to maintain independence of frequency with VDD. This is accomplished by using BEND and VIBRATO signals from microprocessor 205 which swing to the power supply rails in conjunction with a resistor network 1318, which is biased to the same power supply rails (VDD and ground), to provide input to the bend-/vibrato circuit 245. Specifically, the BEND and VIBRATO signals are applied to resistor network 1318 so as to produce a voltage VRN which has the values shown in Table 2. Each musical step corresponds to a ratio of 1 to the twelfth root of 2.

TABLE 2

| | | |
|---|---|---|
| BEND = 0 | VRN=2/5 | (1.06) VDD (musical half step up) |
| BEND = hi z | VRN=2/5 | VDD |
| BEND = 1 | VRN=2/5 | (0.94) VDD (musical half step down) |

Bend/vibrato circuit 245 causes the voltage of VBIAS to follow the voltage VRN with a limit on rate of change of VBIAS. Specifically, the slew rate is limited to approximately 20 ms milliseconds for a musical step. This gives the musically pleasing effect of a smooth bend of pitch from one note to the next rather than an abrupt change of pitch. In explanation of the circuits operation, and referring to the waveforms in FIG. 15*a*, assume both VRN from resistor network 1318 and VBIAS are both at 2/5 VDD. If a bend up command is executed VRN abruptly goes up by six percent and operational amplifier 1319 has its inputs unbalanced. This causes the output of amplifier 1319 to swing to its maximum positive level. VBIAS, the voltage on capacitor 1320, which was at 2/5 VDD, will begin to steadily increase as capacitor 1320 is charged through resistor 1321. This will continue until VBIAS reaches the new value of VRN at which time the amplifier 1319 will begin to regulate VBIAS to VRN as its inputs are in balance. A six percent increase in VRN will thus cause VBIAS to smoothly ramp up by six percent. This increase in VBIAS will increase the frequency of VCO 220 by six percent which makes the instrument sound go up a musical half step.

Since resistor network 1318 is configured as a voltage divider, VBIAS is proportional to the power supply voltage VDD. This insures that changes in VBIAS are always truly 3% and 6% proportional changes unaffected by changes or fluctuations in the power supply voltage VDD. This allows bends to stay on key in spite of voltage fluctuations, such as result from low batteries.

Still referring to FIG. 13, an envelope waveform voltage, ENV, is generated by envelope generator 225, by charging and discharging a capacitor 1322. The voltage ENV' on the negative side of capacitor 1322 is the envelope voltage used to control the sound amplitude.

To simulate the envelope waveform of a guitar, envelope generator 225 has a "pre-attack" mode which corresponds to the motion of a placing a pick on a string, prior to releasing it to sound the note, which causes an accelerated decay of the previous note. This effect is simulated by the moderately rapid discharge via resistor 1323 of the voltage on capacitor 1322 in response to a low PICK signal. Resistor 1323 discharges capacitor 1322 in response to a 25 millisecond low going pulse on the PICK output of microprocessor 205, which corresponds to a hammer-on. The time constant is approximately 10 msec. The PICK signal then goes high (to VDD) for approximately one millisecond to execute the "picking" of the string. This causes emitter follower transistor 1324 to rapidly charge capacitor 1322 up to a junction drop below VDD. Then the PICK signal is switched to tri-state and capacitor 1322 begins to discharge through resistor 1325 to produce a normal, exponential envelope waveform with a time constant of approximately two seconds. The ENV' signal is also buffered by operational amplifier 1326 generating the signal ENV. "Soft" picks for the hammer on effect are generated in a similar manner except that the PICK signal goes high (to VDD) for only approximately one-fifth of a millisecond which causes emitter follower transistor 1324 to only partially charge capacitor 1322. When the hammer-on is released, if the previous note is still held, a slur is generated by merely changing the pitch of the signal and continuing the envelope of the old note with the new pitch. No change is made to the amplitude of the envelope signal.

The envelope waveform ENV is illustrated in FIG. 16. The signal ENV is also summed with COUT in summer 257 to produce WID, which is used as a variable reference voltage by a comparator circuit 1328, illustrated in FIG. 13. Comparator circuit 1328 changes its output state every time the instantaneous voltage of triangle wave FOUT coincides with the level of reference voltage ENVR. Thus, as reference voltage ENVR decreases with time along with the envelope waveform ENV, there is caused a gradual reduction in the duty-cycle of the square wave signal MODA produced by comparator 1328. The inventor has found that the variation of pulse width with the envelope contributes significantly to producing a "voice" quite similar to an electric guitar.

Chorus circuit 255, which comprises a triangle wave oscillator as illustrated in FIG. 13, can provide either a chorus effect or a vibrato effect depending on frequency of oscillation of the chorus circuit. If the chorus effect is to be turned off, the CHORUS output of microprocessor 205 is set to a low state and chorus circuit 255 is forced to a low output state by resistor divider 1329 and 1330. If chorus is turned on microprocessor 205 sets the CHORUS output to a tri-state or high impedance, chorus circuit 255 produces a triangle wave output on node 1331. This waveform is summed with the ENV signal to produce the pulse width control signal ENVR. In the preferred embodiment the frequency of oscillation of chorus circuit 255 is set at 5 Hz.

Referring to FIG. 13, the output stage of comparator 1336 (overdrive circuit 235) and resistor 1325 (envelope generator 225) comprise modulator 237 of FIG. 2. Comparator 1336 has an open collector and pulls STROUT to ground to vary the pulse width of STROUT, and the amplitude of STROUT is set by ENV'. When the comparator output is high, STROUT is pulled up to the voltage ENV' by resistor 1325. (In envelope generator 225.)

Decreasing the pulse width of STROUT in response to the decreasing envelope amplitude, which decreases with time, produces a desirable "twang" effect. The resulting audio waveform STROUT has a frequency set by FOUT (in VCO 22), a pulse width set by pulse width modulator 230 (a function of ENV, and an amplitude set by ENV. This signal is applied to volume control 140 and thence to an audio amplifier 240 as illustrated in FIG. 14.

The ODR output of microprocessor 205, illustrated in FIG. 15 (*c*), is nominally placed in the high impedance (Hi-z) state to disable the overdrive effect. Overdrive circuit 235 is activated by a low output of microprocessor 205 on the ODR line. Overdrive circuit 235 generates an effect similar in effect to the overdrive distortion favored by rock musicians and usually implemented with tube-type amplifiers operated at severe overload levels. The present circuit generates a pulse at both the leading and trailing of MODA to simulate the effect. In detail, referring to FIG. 13 and 15, a pulse stream, the MODA signal, illustrated in FIG. 15 (*b*), is applied to the input of capacitor 1332. Capacitor 1332 acts to differentiate input waveform MODA and create positive spikes for each leading edge and negative spikes for each trailing edge of the MODA waveform. The output signal of capacitor 1332, COUT, is illustrated in FIG. 15 (*d*). Divider chain 1333 is arranged so that the voltage on node 1334 is greater than the voltage on node 1335. This normally biases the noninverting input of the comparator 1336 higher than the inverting input which causes comparator 1336 to ground its output STROUT. Comparator 1336 is wired so that when a positive spike is present at COUT, diode 1337 will conduct and the inverting input of comparator 1336 will be forced positive while its noninverting input is biased at the voltage of node 1334. This will cause a positive output from comparator 1336 as long as the spike on COUT exceeds the voltage at node 1334. Similarly a negative going spike on COUT causes diode 1338 to conduct driving the noninverting input of comparator 1336 negative while the inverting input is biased by resistor 1339 to the voltage at node 1335. This causes comparator 1336 to produce a positive output as long as the negative spike falls below the voltage of node 1335. Thus the output STROUT (illustrated in FIG. 15 (*e*)) of comparator 1336 gives a high pulse of fixed pulse width for each leading and each trailing edge of the input waveform MODA. This gives an effective frequency doubling while still retaining some of the tonal characteristics derived from the duty cycle of MODA.

Audio output amp 240 is configured as a noninverting amplifier with gain. The complimentary symmetry output stage acts as emitter followers on the output of the operational amplifier 1410. Output stages of this type are usually biased to carry some quiescent current by means of a diode string between the bases of the output transistors in order to reduce crossover distortion. In the present application it was found that intentionally introducing substantial crossover distortion by eliminating the diodes created a pleasing effect in the guitar tone. It also had the beneficial effect of significantly reducing the quiescent current of the output stage.

The output of audio amp 240 is applied to a conventional loudspeaker 145 and headphone jack 155.

While the invention has been particularly taught and described with reference to the preferred embodiment, those versed in the art will appreciate that minor modifications in form and details may be made without departing from the spirit and scope of the invention. For instance, although the illustrated embodiment shows the invention used in combination with a tremolo bar, in an alternative embodiment a bend control could be place in the neck of the guitar so as to vary the pitch in response to bending the neck relative to the guitar body. Similarly, although the invention illustrates a speaker and audio amplifier built into the toy guitar it would be equivalent to merely generate an audio signal compatible with conventional sound amplifiers such as used with real electric stringed guitars. Further, while the musical tracks have been written using C major, C minor, and C pentatonic scales and the manual notes belong only to the C pentatonic scale, it would be equivalent to use any other key. Accordingly, all such modifications are embodied within the scope of this patent as properly come within our contribution to the art and are particularly pointed out by the following claims.

We claim:

1. An electric musical instrument comprising:

means for storing information defining the notes and timing of different preprogrammed musical tracks;

a number of manually operable track buttons, each associated with a different preprogrammed musical track;

means for sounding the notes of a preprogrammed musical track in response to the activation of the associated track button; and tempo means for synchronizing the sound of the sounded notes with a clock signal;

wherein if a second track button is activated while a previously activated track button is still active, the sounding of the first musical track is suppressed and the second musical track is sounded without loss of tempo at the next quarter beat time from an intermediate time position in the second musical track corresponding to the time position in the first track.

2. An electric musical instrument comprising:

means for storing information defining the notes and timing of the different preprogrammed musical tracks;

a number of manually operable track buttons, each associated with a different preprogrammed musical track;

a number of manually operable note buttons, each button associated with a different musical note;

tempo means for synchronizing the sound of the sounded notes with a clock signal; and tone generator means for generating an electrical signal corresponding to the notes of a preprogrammed musical track in response to the activation of the corresponding track button and for generating an electrical signal corresponding to a note in response to the activation of each of the corresponding note buttons, wherein the notes of any preprogrammed musical track are suppressed during the generation of the electrical signal corresponding to a note associated with a manually activated note button;

wherein if a track button has remained activated during the activation and release of a note button, the musical track will resume play after the release of the note button at the same place in the track as it would have been if the play of the track had not been suppressed, and wherein the suppressed track will resume play only after the note button is released and a delay of an eighth beat has elapsed without another manual note being played.

3. A frequency generator for use in a musical tone generator for generating a frequency independent of variations in the power supply voltage, said frequency generator comprising:

a digital-to-analog converter for providing an anlaog signal proportional to a power supply voltage and a digital value;

a tuning potentiometer coupled to the digital-to-analog converter for providing a pitch signal proportional to the analog signal and the position of the potentiometer;

a bias signal generator for generating a bias signal proportional to the power supply voltage; and a voltage controlled oscillator coupled to the bias signal generator and to the tuning potentiometer for providing a periodic signal having a frequency proportional to the pitch signal and inversely proportional to the bias signal.

4. An electric musical instrument including a circuit for simulating an overdrive effect of an electric guitar, the circuit comprising:

frequency generator means for providing a periodic waveform having a first frequency;

a comparator having a first input, a second input, and an output;

a first diode having an anode coupled to the first input of the comparator and having a cathode;

a second diode having an cathode coupled to the second input of the comparator and having an anode coupled to the cathode of the first diode;

a power supply connection;

a ground connection;

a resistive voltage divider coupled between the power supply connection and the ground connection and having an upper and a lower tap;

a first resistor coupled between the upper tap and the first input of the comparator;

a second resistor coupled between the lower tap and the second input of the comparator; and a capacitor having a first terminal coupled to the frequency generator means for receiving the periodic waveform and having a second terminal coupled to the cathode of the first diode.

5. An electric musical instrument including a tone generator for simulating an electric guitar as in claim 4 further comprising deactivation means comprising:

a third diode having a cathode coupled to the second input of the comparator;

a fourth diode having a cathode and having an anode coupled to the anode of the third diode;

control signal generator means for selectively coupling a ground or a high impedance to the cathode of the fourth diode, and a third resistor having a first terminal coupled to the anodes of the third and fourth diodes and having a second terminal coupled to the first terminal of the capacitor.

6. Sound producing apparatus for generating triplets comprising: a number of manually operable note buttons, each associated with a different musical note; means for sounding a note in response to the activation of each of the note buttons; and automatic triplet generator means for detecting when a first, a second and a third note button are all active at the same time, for suppressing the sounding of the note buttons by the means for sounding in response to said detection, and for sounding a triplet in response to said detection.

7. Sound producing apparatus for generating triplets as in claim 6 wherein said triplet comprises three consecutive notes of a musical scale including a note associated with the second note button.

8. Sound producing apparatus for generating triplets as in claim 6 further comprising tempo means for synchronizing the sounding of the notes produced by the means for sounding and the play of the triplet with a clock signal.

9. Sound producing apparatus for generating triplets as in claim 6 wherein the first two note buttons played are used to determine the starting pitch and the direction of the triplet, up or down, based on the relationship of the first two notes; if the direction of the triplet is up, then the triplet is composed by playing the note below note 2 (the second note), note 2, and the note above note 2; if the direction of the triplet is down, the triplet is composed by playing the note above note 2, note 2, and the note below note 2.

10. Sound producing apparatus for generating triplets as in claim 9 wherein the triplet is played repetitively in response to the continued detection of a first, a second and a third note buttons being pressed simultaneously.

11. Sound producing apparatus for generating triplets comprising:

a number of manually operable note buttons, each associated with a different musical note; means for sounding a note in response to the activation of each of the note buttons; and automatic triplet generator means for detecting when a first, a second and a third note button are all active at the same time, for suppressing the sounding of the note buttons in response to said detection, and for sounding a triplet in response to said detection; and tempo means for synchronizing the sounding of the notes produced by the means for sounding and the play of the triplet with a clock signal;

wherein said triplet comprises three consecutive notes of a musical scale including a note associated with the second note button and the first two note buttons played are used to determine the starting pitch and the direction of the triplet, up or down, based on the relationship of the first two notes; wherein if the direction of the triplet is up, then the triplet is composed by playing the note below note 2 (the second note), note 2, and the note above note 2; or if the direction of the triplet is down, the triplet is composed by playing the note above note 2, note 2, and the note below note 2.

12. Sound producing apparatus for generating triplets as in claim 11 wherein the triplet is played repetitively in response to the continued detection of a first, a second, and a third note buttons all being active at the same time.

* * * * *